US008581525B2

(12) United States Patent
Antaya et al.

(10) Patent No.: US 8,581,525 B2
(45) Date of Patent: Nov. 12, 2013

(54) COMPENSATED PRECESSIONAL BEAM EXTRACTION FOR CYCLOTRONS

(75) Inventors: Timothy A. Antaya, Hampton Falls, NH (US); Jun Feng, Cambridge, MA (US); Alexey Radovinsky, Cambridge, MA (US); Stanislaw P. Sobczynski, Boxford, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 13/429,012

(22) Filed: Mar. 23, 2012

(65) Prior Publication Data

US 2013/0249443 A1 Sep. 26, 2013

(51) Int. Cl.
*H05H 13/00* (2006.01)

(52) U.S. Cl.
USPC ..... 315/502; 336/185; 336/186; 315/500; 315/501

(58) Field of Classification Search
USPC ..... 315/500–502
See application file for complete search history.

(56) References Cited

U.S. PATENT DOCUMENTS

| | | | | |
|---|---|---|---|---|
| 1,948,384 | A | 2/1934 | Lawrence | |
| 5,436,537 | A * | 7/1995 | Hiramoto et al. | 315/507 |
| 6,683,426 | B1 | 1/2004 | Kleeven | |
| 7,541,905 | B2 * | 6/2009 | Antaya | 335/216 |
| 7,656,258 | B1 * | 2/2010 | Antaya et al. | 335/216 |
| 7,696,847 | B2 | 4/2010 | Antaya | |
| 7,920,040 | B2 * | 4/2011 | Antaya et al. | 336/185 |
| 8,111,125 | B2 * | 2/2012 | Antaya et al. | 336/185 |
| 2012/0126726 | A1 * | 5/2012 | Antaya | 315/502 |
| 2012/0142538 | A1 * | 6/2012 | Antaya et al. | 505/211 |
| 2012/0217903 | A1 * | 8/2012 | Tanaka et al. | 315/502 |

FOREIGN PATENT DOCUMENTS

EP 1 069 809 A1 1/2001

OTHER PUBLICATIONS

H. Kim, "Regenerative Beam Extraction", IEEE Transactions on Nuclear Science Proceedings of the International Conference on Isochronous Cyclotrons, vol. NS-13, No. 4, 58-63 (Aug. 1996).

A.V. Crewe, et al., "Regenerative beam extraction on the Chicago synchrocyclotron", Review of Scientific Instruments, vol. 27, No. 1, 5-8 (Jan. 1956).

European Patent Office, International Search Report and Written Opinion for PCT/US2013/032770 (Jul. 31, 2013).

* cited by examiner

*Primary Examiner* — Daniel Cavallari
*Assistant Examiner* — Srinivas Sathiraju
(74) *Attorney, Agent, or Firm* — Modern Times Legal; Robert J. Sayre

(57) ABSTRACT

A plurality of magnetic extraction bumps are incorporated into a cyclotron that further includes (a) a pair of magnetic coils encircling a central axis and positioned on opposite sides of a median acceleration plane and (b) a magnetic yoke encircling the central axis and including a return yoke that crosses the median acceleration plane and a first and second pole on opposite sides of the median acceleration plane. The magnetic extraction bumps extend in series radially from the central axis on opposite sides of the median acceleration plane and can be used to extract an orbiting accelerated ion from the cyclotron.

20 Claims, 11 Drawing Sheets

COMPENSATED PRECESSIONAL BEAM EXTRACTION FOR CYCLOTRONS

BACKGROUND

A cyclotron accelerates charged particles (ions) in an outward spiraling orbit from an ion source located near a central axis to an outer radius at which the ions are extracted from the cyclotron. An early classical cyclotron is disclosed in U.S. Pat. No. 1,948,384 (inventor: Ernest O. Lawrence). In the classical cyclotron, ions are introduced into the acceleration chamber, which is evacuated, from any of a variety of sources (e.g., emitted from a heated filament or from bombarded lithium or discharged from a hot cathode). The ion is accelerated in the cyclotron chamber by a pair of electrodes, wherein the electrodes provide a high-frequency alternating or oscillating electric potential difference to cumulatively increase the speed of the ion as it travels in a substantially circular orbit of increasing radius in the chamber. The orbit of the accelerating ion is in resonance or is synchronized with oscillations in the electric accelerating field(s) to repeatedly accelerate the ion at successive half revolutions.

Specifically, the ion, when positioned between the electrodes, is attracted to the interior of the electrode that has a charge at that moment that is opposite to the charge of the ion; and the ion gains velocity from the charge attraction. The shift in the electric potential of each electrode shapes the substantially circular orbit of the ion. As the electric potentials of the electrodes are reversed, the ion is then accelerated into the interior of the other electrode; and the cycle is repeated. As the ion gradually spirals outward, the velocity of the ion increases proportionally to the increase in radius of its orbit, until the ion is eventually deflected into a collector channel to allow the ion to deviate outwardly from the magnetic field and to be extracted from the cyclotron.

The orbital pathway of each ion is further governed by a magnetic field generated by two poles on opposite sides of the electrodes. The poles produce a substantially uniform magnetic field with field lines extending transversely to the electrodes and normal to the plane of the electric field between the electrodes to provide weak-focusing to maintain the accelerating ions in or near the median acceleration plane of the chamber (i.e., providing vertical stability). A modern version of a classical cyclotron is described in U.S. Ser. No. 12/951,968, filed 22 Nov. 2010 (T. Antaya, inventor).

In addition to classical cyclotrons, current classes of cyclotrons include synchrocyclotrons and isochronous cyclotrons. Modern cyclotrons are primarily of the isochronous cyclotron type.

Like classical cyclotrons, synchrocyclotrons feature a magnetic field that decreases with increasing radius and is shaped to provide weak focusing. However, while the electrodes are operated at a fixed frequency in classical cyclotrons, the frequency of the applied electric field in a synchrocyclotron is adjusted as the particles are accelerated to account for relativistic increases in particle mass at increasing velocities at increasing radii. Synchrocyclotrons are also characterized in that they can be very compact, and their size can shrink almost cubically with increases in the magnitude of the magnetic field generated between the poles. High-field synchrocyclotrons are described in U.S. Pat. No. 7,541,905, issued to inventor Timothy Antaya, and U.S. Pat. No. 7,656,258, issued to Timothy Antaya, et al.

Like classical cyclotrons, the acceleration frequency in an isochronous cyclotron is fixed. Unlike the radially decreasing magnetic field in a classical cyclotron, however, the magnetic field in an isochronous cyclotron increases with radius to compensate for relativity. And unlike the weak focusing provided by the magnetic field in a classical cyclotron, an azimuthally varying magnetic field component is derived from contoured iron flutter pole pieces having a sector periodicity to provide an axial restoring force as ions are accelerated. Some isochronous cyclotrons use superconducting magnet technology, in which superconducting coils magnetize iron poles that provide the guiding and focusing fields for ion acceleration.

The magnetic field at the edge of a cyclotron is generally unsuitable for acceleration, so the beam reaches full energy before the edge field is encountered, though the beam then passes through the edge field as it is extracted from the cyclotron. The longer the beam takes to traverse the edge, the more the beam quality is affected. In addition, some asymmetric field elements are included in the chamber design to separate the extracted beam from the internal orbits and direct the beam into the extraction path. These asymmetric field elements may be magnetic or electric; electric field elements are more common, though the electric field strengths required are large, and these large field requirements tend to make the electrical field elements unreliable. Hence, beam extraction is one of the main challenges of cyclotron design. Even after careful design and implementation of ion introduction and beam acceleration, proper extraction of the ion beam promotes good beam quality. Effective ion beam extraction and good beam quality is particularly advantageous for applications where the beam will be used for patient treatment, as inadequate beam quality (emittance) can result in relatively large unintended radiation (from the beam striking part of the beam chamber or other surfaces).

The extraction problem is aggravated in compact high-field cyclotrons, as for a given energy gain per turn, the spatial difference between consecutive ion orbits is small compared with those in larger, lower-field cyclotrons, thereby making beam extraction at a particular orbit more challenging.

SUMMARY

Apparatus and methods for improved ion beam extraction in a cyclotron are described herein. Various embodiments of the apparatus and method may include some or all of the elements, features and steps described below.

As described, herein, ions can be extracted from cyclotrons (e.g., high-field synchrocyclotrons and classical cyclotrons) by pushing the ions close to the edge of the acceleration chamber, while maintaining magnetic field quality and orbit properties, by introducing a small passive magnetic perturbation that results in a clear separation of the extracted orbit from the last internal orbit without the use of any actively electric or magnetic elements.

As described, herein, a cyclotron including a pair of magnetic coils encircling a central axis and positioned on opposite sides of a median acceleration plane, and a magnetic yoke encircling the central axis and including a return yoke that crosses the median acceleration plane and a first and second pole on opposite sides of the median acceleration plane, further includes a plurality of magnetic extraction bumps extending in series radially from the central axis on opposite sides of the median acceleration plane for extracting an orbiting accelerated ion from the cyclotron.

The cyclotron of claim 1, can further include an ion source proximal the central axis (e.g., not directly on the central axis but adjacent thereto—for example, spaced less than a centimeter from the central axis) and on or proximate to the median acceleration plane so that the released ion can fall into orbit in or about the median acceleration plane.

The magnetic extraction bumps and the magnetic yoke can comprise iron (e.g., low-carbon steel), while the magnetic coils can comprise a superconducting material, such as niobium tin or niobium titanium.

The magnetic extraction bumps can be confined to an angle no greater than 30° about the central axis; and at least five magnetic extraction bumps can be provided, each separate from the other magnetic extraction bumps and extending across a distinct radial distance from the central axis. In particular embodiments, the magnetic extraction bumps can be radially separated from each other by at least 1 cm and, together, can extend across radii of about one-half the pole radius from the central axis to about the pole radius. Further, the height of the magnetic extraction bumps can increase with increasing radius from the central axis such that magnetic extraction bumps at shorter radii have lower heights than magnetic extraction bumps at greater radii; and the bump heights (measured orthogonal to the median acceleration plane) can range, for example, from 0.1 to 4 cm with radial depths (i.e., extending across a radial span) in a range from 0.5 to 3 cm.

In a method for ion extraction from a cyclotron, an ion is released into an acceleration chamber contained in the cyclotron and accelerated in an outward spiral orbit in the acceleration chamber. The accelerated ion can then be extracted from the acceleration chamber via a magnetic-field perturbation produced by the series of magnetic extraction bumps.

The cyclotron includes a pair of magnetic poles on opposite sides of the acceleration chamber and encircling and extending from the central axis, and the ion can reach full energy in the acceleration chamber at a radius greater than 93% of the pole radius. In particular embodiments, the cyclotron generates a magnetic field greater than 6 Tesla in the acceleration chamber; and the localized magnetic-field perturbation provided by the magnetic extraction bumps can be passively generated by the bumps.

The magnet structure is also designed to provide weak focusing and phase stability in the acceleration of charged particles (ions) in the acceleration chamber. Weak focusing is what maintains the charged particles in space while accelerating in an outward spiral through the magnetic field. Phase stability ensures that the charged particles gain sufficient energy to maintain the desired acceleration in the chamber. Specifically, more voltage than is needed to maintain ion acceleration is provided at all times to high-voltage electrodes in the acceleration chamber; and the magnet structure is configured to provide adequate space in the acceleration chamber for these electrodes and also for an extraction system to extract the accelerated ions from the chamber.

In one embodiment, the magnet structure can be used in an ion accelerator that includes a cold-mass structure including at least two superconducting coils symmetrically positioned on opposite sides of an acceleration plane and mounted in a cold bobbin that is suspended by tensioned elements in an evacuated cryostat. Surrounding the cold-mass structure is a magnetic yoke formed, e.g., of low-carbon steel. Together, the cold-mass structure and the yoke generate a combined field, e.g., of about 6 Tesla or more (and in particular embodiments, 7-9 Tesla or more) in the acceleration plane of an evacuated beam chamber between the poles for accelerating ions. The superconducting coils generate a substantial majority of the magnetic field in the chamber, e.g., about 5 Tesla or more (and in particular embodiments, about 7 Tesla or more) when the coils are placed in a superconducting state and when a voltage is applied thereto to initiate and maintain a continuous electric current flow through the coils. The yoke is magnetized by the field generated by the superconducting coils and can contribute another 2 Tesla to the magnetic field generated in the chamber for ion acceleration.

With the high magnetic fields, the magnet structure can be made exceptionally small. In one embodiment with a combined magnetic field of 7 Tesla in the acceleration plane, the outer radius of the magnetic yoke is 45 inches (about 114 cm) or less. In magnet structures designed for use with higher magnetic fields, the outer radius of the magnetic yoke can be even smaller. Particular additional embodiments of the magnet structure are designed for use where the magnetic field in the median acceleration plane is, e.g., 8.9 Tesla or more, 9.5 Tesla or more, 10 Tesla or more, at other fields between 7 and 13 Tesla, and at fields above 13 Tesla.

BRIEF DESCRIPTION OF THE DRAWINGS

In the accompanying drawings, like reference characters refer to the same or similar parts throughout the different views. The drawings are not necessarily to scale, emphasis instead being placed upon illustrating particular principles, discussed below.

DETAILED DESCRIPTION

Figure 1:
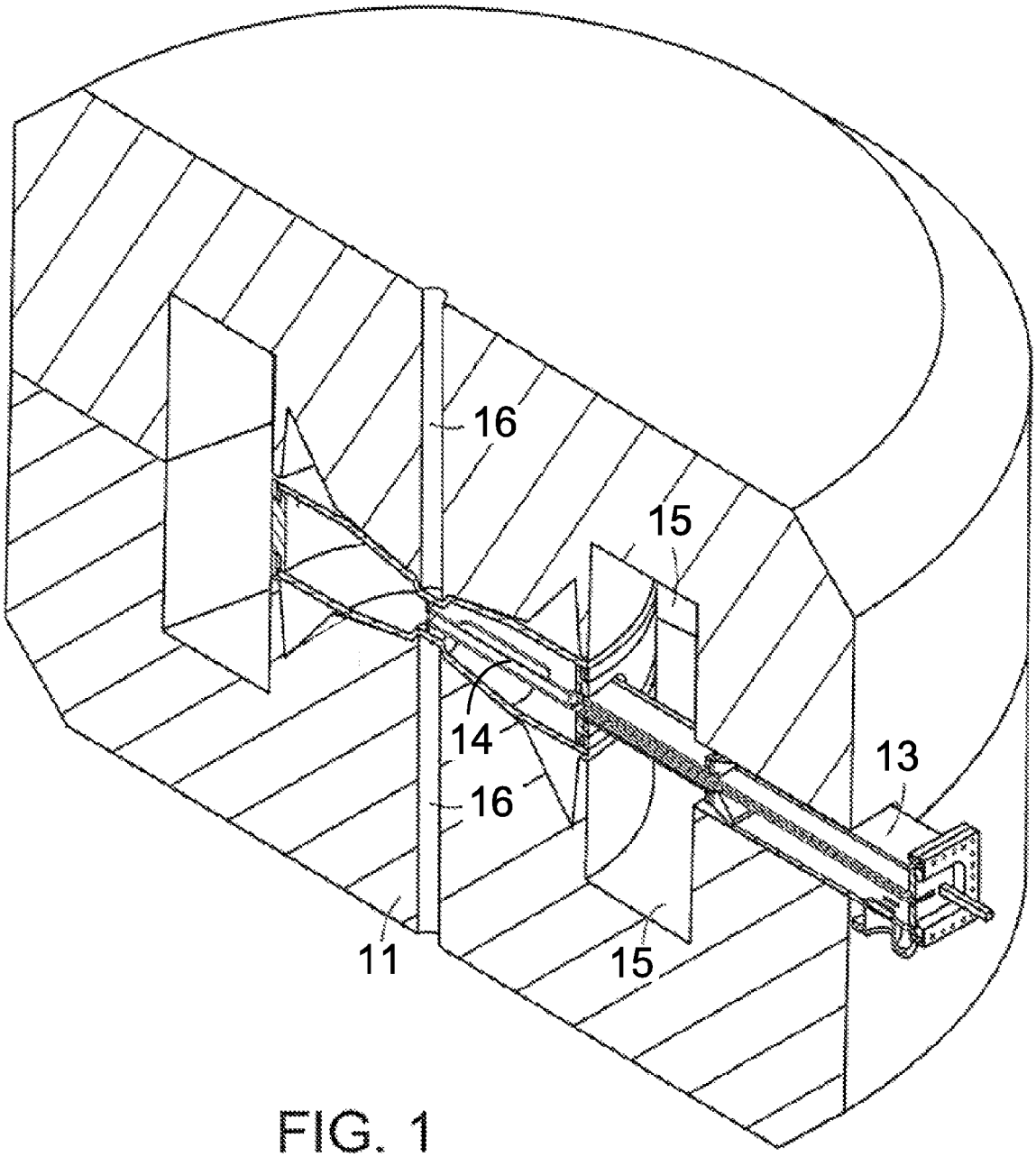
FIG. 1 is a perspective sectioned diagram showing the basic structure of a high-field synchrocyclotron, omitting the coil/cryostat assembly.

The foregoing and other features and advantages of various aspects of the invention(s) will be apparent from the following, more-particular description of various concepts and specific embodiments within the broader bounds of the invention(s). Various aspects of the subject matter introduced above and discussed in greater detail below may be implemented in any of numerous ways, as the subject matter is not limited to any particular manner of implementation. Examples of specific implementations and applications are provided primarily for illustrative purposes.

Unless otherwise defined, used or characterized herein, terms that are used herein (including technical and scientific terms) are to be interpreted as having a meaning that is consistent with their accepted meaning in the context of the relevant art and are not to be interpreted in an idealized or overly formal sense unless expressly so defined herein. For example, if a particular composition is referenced, the composition may be substantially, though not perfectly pure, as practical and imperfect realities may apply; e.g., the potential presence of at least trace impurities (e.g., at less than 1 or 2%, wherein percentages or concentrations expressed herein can be either by weight or by volume) can be understood as being within the scope of the description; likewise, if a particular shape is referenced, the shape is intended to include imperfect variations from ideal shapes, e.g., due to manufacturing tolerances.

Although the terms, first, second, third, etc., may be used herein to describe various elements, these elements are not to be limited by these terms. These terms are simply used to distinguish one element from another. Thus, a first element, discussed below, could be termed a second element without departing from the teachings of the exemplary embodiments.

Spatially relative terms, such as "above," "below," "left," "right," "in front," "behind," and the like, may be used herein for ease of description to describe the relationship of one element to another element, as illustrated in the figures. It will be understood that the spatially relative terms, as well as the illustrated configurations, are intended to encompass different orientations of the apparatus in use or operation in addition to the orientations described herein and depicted in the figures. For example, if the apparatus in the figures is turned over, elements described as "below" or "beneath" other elements or features would then be oriented "above" the other elements or features. Thus, the exemplary term, "above," may encompass both an orientation of above and below. The apparatus may be otherwise oriented (e.g., rotated 90 degrees or at other orientations) and the spatially relative descriptors used herein interpreted accordingly.

Further still, in this disclosure, when an element is referred to as being "on," "connected to" or "coupled to" another element, it may be directly on, connected or coupled to the other element or intervening elements may be present unless otherwise specified.

The terminology used herein is for the purpose of describing particular embodiments and is not intended to be limiting of exemplary embodiments. As used herein, singular forms, such as "a" and "an," are intended to include the plural forms as well, unless the context indicates otherwise. Additionally, the terms, "includes," "including," "comprises" and "comprising," specify the presence of the stated elements or steps but do not preclude the presence or addition of one or more other elements or steps.

Acceleration Fundamentals in the Context of a Synchrocyclotron:

Synchrocyclotrons, in general, may be characterized by the charge, Q, of the ion species; by the mass, M, of the accelerated ion; by the acceleration voltage, $V_0$; by the final energy, E; by the final radius, r, from a central axis; by the magnetic field, B (along the z axis), at radius, r; and by the central field, $B_0$, where $B_0=B_z(0)$. The parameters, B and r, are related to the final energy such that only one need be specified. In particular, one may characterize a synchrocyclotron by the set of parameters, Q, M, E, $V_0$ and $B_0$. The high-field superconducting synchrocyclotron of this discourse includes a number of important features and elements, which function, following the principles of synchronous acceleration, to create, accelerate and extract ions of a particular Q, M, $V_0$, E and B. In addition, when the central field alone is raised and all other key parameters held constant, it is seen that the final radius of the accelerator decreases in proportion; and the synchrocyclotron becomes more compact. This increasing overall compactness with increasing central field, $B_0$, can be characterized approximately by the final radius to the third power, $r^3$, and is shown in the table below, in which a large increase in field results in a large decrease in the approximate volume of the synchrocyclotron.

| B (Tesla) | r (m) | $(r/r_1)^3$ |
|---|---|---|
| 1 | 2.28 | 1 |
| 3 | 0.76 | 1/27 |
| 5 | 0.46 | 1/125 |
| 7 | 0.33 | 1/343 |
| 9 | 0.25 | 1/729 |

The final column in the above chart represents the volume scaling, wherein $r_1$ is the pole radius of 2.28 m, where B is 1 Tesla; and r is the corresponding radius for the central field, $B_0$, in each row. In this case, $M=\rho_{iron}V$, and $E=K(rB)^2=250$ MeV, wherein V is volume.

One factor that changes significantly with this increase in central field, $B_0$, is the cost of the synchrocyclotron, which will decrease. Another factor that changes significantly is the portability of the synchrocyclotron; i.e., the synchrocyclotron should be easier to relocate; for example, the synchrocyclotron can then be placed upon a gantry and moved around a patient for cancer radiotherapy, or the synchrocyclotron can be placed upon a cart or a truck for use in mobile applications, such as gateway-security-screening applications utilizing energetic beams of point-like particles. Another factor that changes with increasing field is size; i.e., all of the features and essential elements of the synchrocyclotron and the properties of the ion acceleration also decrease substantially in size with increasing field. Described herein is a manner in which the synchrocyclotron may be significantly decreased in overall size (for a fixed ion species and final energy) by raising the magnetic field using superconducting magnetic structures that generate the fields.

With increasing field, B, the synchrocyclotron possesses a structure for generating the required magnetic energy for a given energy, E; charge, Q; mass, M; and accelerating voltage, $V_0$. This magnetic structure provides stability and protection for the superconducting elements of the structure, mitigates the large electromagnetic forces that also occur with increasing central field, $B_0$, and provides cooling to the superconducting cold mass, while generating the required total magnetic field and field shape characteristic of synchronous particle acceleration.

The yoke 11, dee 14 and resonator structure 13 of a 9.2-Tesla, 250-MeV-proton superconducting synchrocyclotron including $Nb_3Sn$-conductor-based superconducting coils (not shown) operating at peak fields of 11.2 Tesla are illustrated in FIG. 1. This synchrocyclotron solution was predicated by a new scaling method from the solution obtained at 5.5 Tesla in X. Wu, "Conceptual Design and Orbit Dynamics in a 250 MeV Superconducting Synchrocyclotron" (1990) (Ph.D. Dissertation, Michigan State University); it is believed that the Wu thesis suggested the highest central field ($B_0$) level in a design for a synchrocyclotron up to that point in time—provided in a detailed analysis effort or demonstrated experimentally in operation.

These high-field scaling rules do not require that the new ion species be the same as in the particular examples provided herein (i.e., the scaling laws are more general than just 250 MeV and protons); the charge, Q, and the mass, M, can, in fact, be different; and a scaling solution can be determined for a new species with a different Q and M. For example, in another embodiment, the ions are carbon atoms stripped of electrons for a +6 charge (i.e., $^{12}C^{6+}$). Also, the new scaled energy, E, may be different from the previous final energy. Further still, $B_0$ can also be changed. With each of these changes, the synchrocyclotron mode of acceleration can be preserved.

Synchrocyclotron Configuration:

The ferromagnetic iron yoke 11 surrounds the accelerating region in which the beam chamber, dee 14 and resonator structure 13 reside; the yoke 11 also surrounds the space for the magnet cryostat, indicated by the upper-magnet cryostat cavity 15 and by the lower-magnet cryostat cavity 15. The acceleration-system beam chamber, dee 14 and resonator structure 13 are sized for an E=250 MeV proton beam (Q=1 and M=1) at an acceleration voltage, $V_0$, of less than 20 kV. The ferromagnetic iron core and return yoke 11 is designed as a split structure to facilitate assembly and maintenance; and it has an outer radius less than 35 inches (~89 cm), a total height less than 40 inches (~100 cm), and a total mass less than 25 tons (~23,000 kg). The yoke 11 is maintained at room temperature. This particular solution can be used in any of the previous applications that have been identified as enabled by a compact, high-field superconducting synchrocyclotron, such as on a gantry, a platform, or a truck or in a fixed position at an application site.

Figure 2:
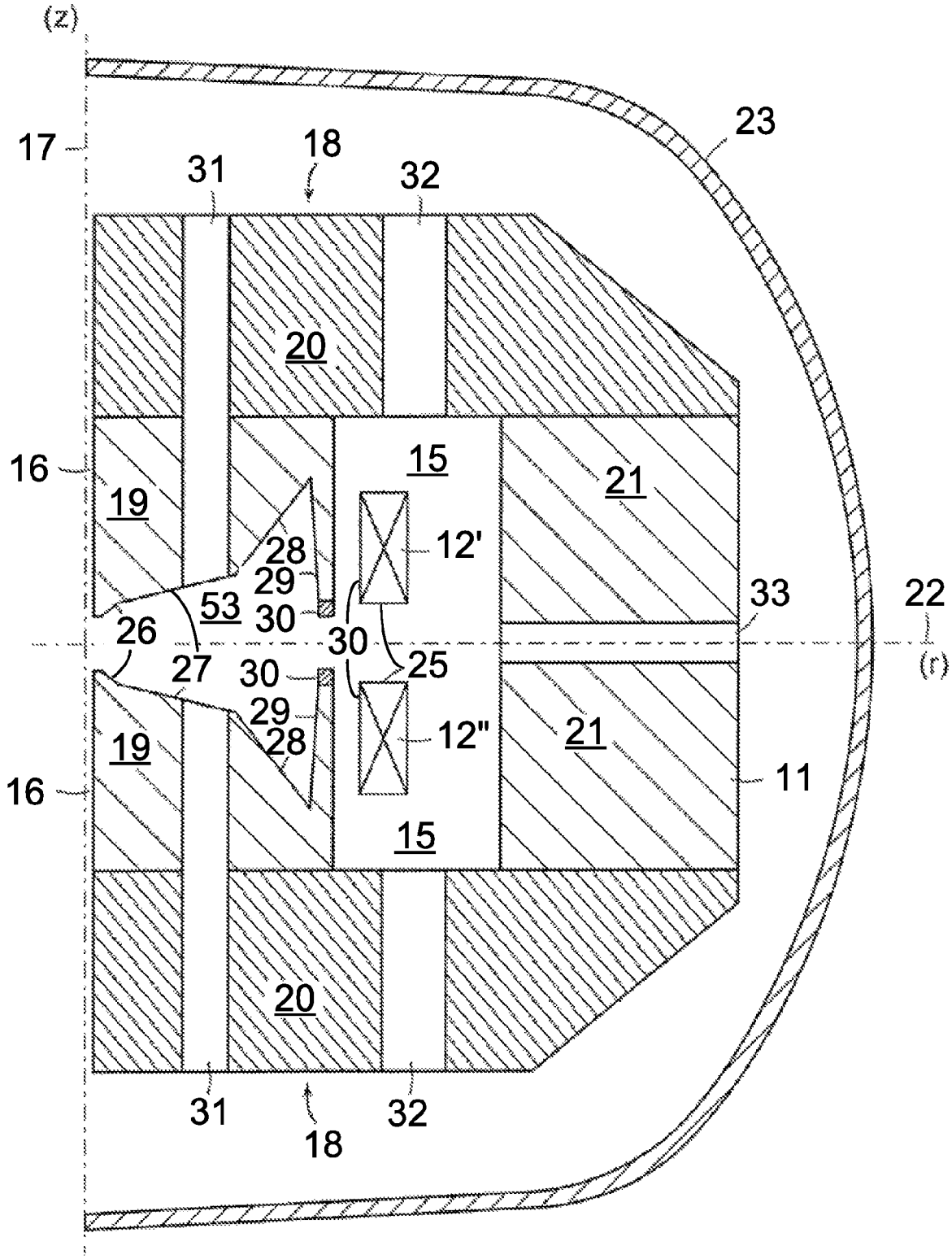
FIG. 2 is a vertical sectional illustration of the ferromagnetic material and the magnet coils for the high-field synchrocyclotron.

For clarity, numerous other features of the ferromagnetic iron yoke structure 11 for high-field synchrocyclotron operation are not shown in FIG. 1. Many of these additional features are shown in FIG. 2. The structure of the synchrocyclotron approaches 360-degree azimuthal symmetry about its central axis 17, allowing for discrete ports and other discrete features at particular locations, as illustrated, e.g., in FIG. 6. The synchrocyclotron also has a median acceleration plane 22, which is the mirror-symmetry plane for the ferromagnetic yoke 11, and the mid-plane of the split pair of coils 12; the median acceleration plane also is the vertical center of the beam chamber (defined between the poles 18), dee 14 and resonator structure 13 and of the particle trajectories during acceleration. The ferromagnetic yoke structure 11 of the high-field synchrocyclotron is composed of multiple elements. The magnet poles 18 define upper and lower central passages 16, aligned about the central axis 17 of the synchrocyclotron, and each passage 16 has a diameter of about 3 inches (~7.6 cm). The passages 16 accordingly provide access for insertion and removal of the ion source, which is positioned on or proximate to the central axis 17 at the median acceleration plane 22 in the central region of the acceleration chamber 44.

Yoke Structure:

A magnetic yoke 11 formed of low-carbon steel surrounds the coils 12 and cryostat 35. Pure iron may be too weak and its elastic modulus may be too low; consequently, the iron can be doped with a sufficient quantity of carbon and other elements to provide adequate strength or to render it less stiff while retaining the desired magnetic levels. The yoke 11 circumscribes the same segment of the central axis 17 that is circumscribed by the coils 12 and the cryostat 35. The radius (measured from the central axis 17) at the outer surfaces of the yoke 11 can be about 35 inches (~89 cm) or less.

Figure 3:
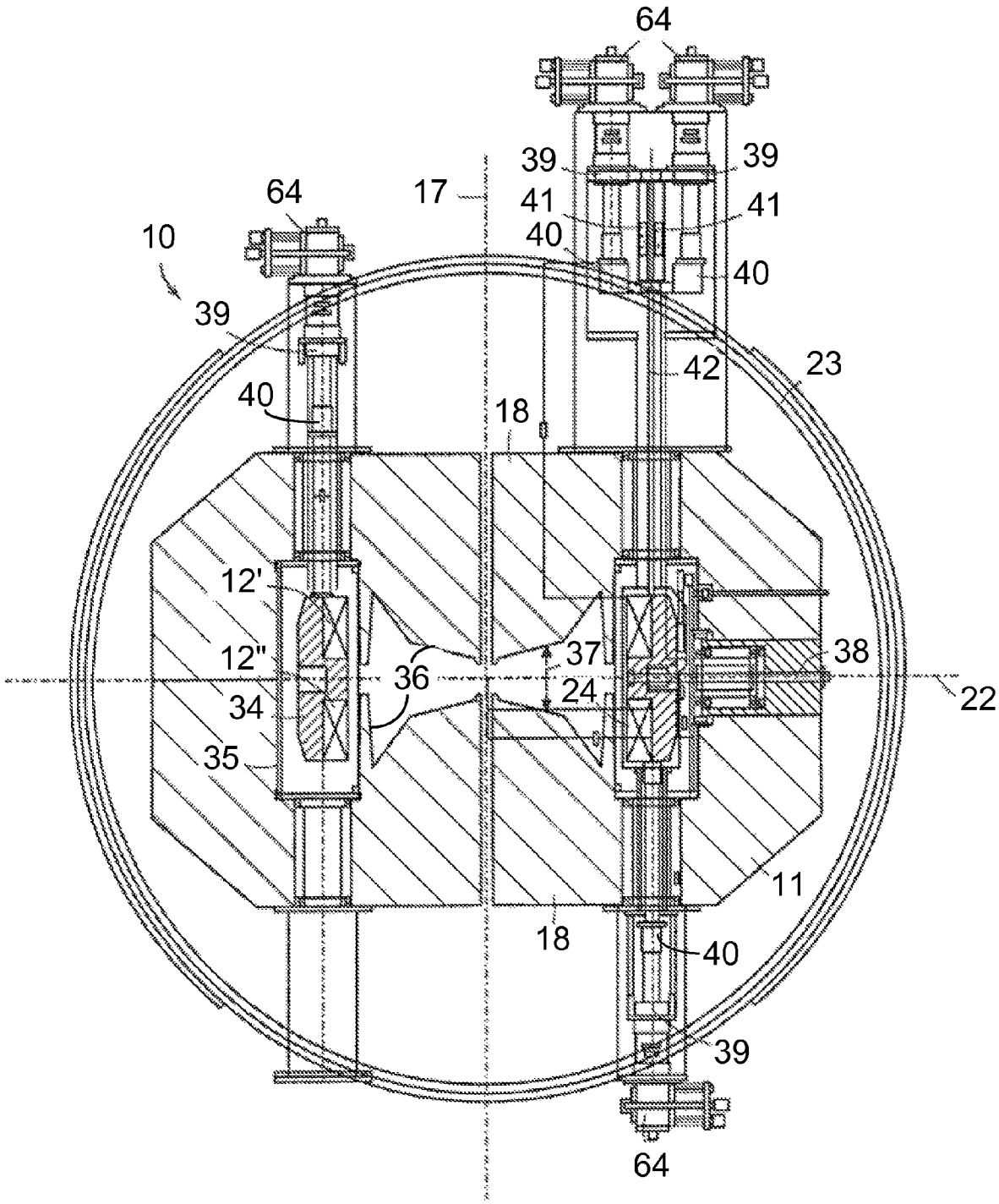
FIG. 3 is a sectional illustration of a magnet structure, viewed in a plane in which the central axis of the magnet structure lies.

As shown in FIG. 3, the yoke 11 includes a pair of poles 18 having tapered inner surfaces 36 that define a pole gap 37 between the poles 18 and across the acceleration chamber 44. The profiles of those tapered inner surfaces 36 establish a magnetic field structure that provides stable ion acceleration inside the synchrocyclotron and are a function of the position of the coils 12. The tapered inner surfaces 36 are shaped such that the pole gap 37 (measured as shown by the reference line in FIG. 3) expands over an inner stage defined between opposing surfaces 36 as the distance from the central axis 17 increases and decreases over an outer stage defined between opposing surfaces 36 as the distance from the central axis 17 further increases. The inner stage establishes a correct weak focusing requirement for ion (e.g., proton) acceleration when used, e.g., in a synchrocyclotron for proton acceleration, while the outer stage is configured to reduce pole diameter by increasing energy gain versus radius, which facilitates extraction of ions from the synchrocyclotron as the ions approach the perimeter of the acceleration chamber 44.

The pole profiles 36 are further illustrated in FIG. 2, wherein the detailed magnetic field configuration is provided by shaping of the ferromagnetic iron yoke 11, through shaping of the upper and lower pole tip contours 26 and upper and lower pole contours 27 for initial acceleration and by shaping upper and lower pole contours 28 for high-field acceleration. In the embodiment of FIG. 2, the maximum pole gap between the upper and lower pole contours 28 (adjacent the upper and lower pole wings 29) is more than twice the size of the maximum pole gap between the upper and lower pole contours 27 and more than five times the size of the minimum pole gap at the upper and lower pole tip contours 26. As shown, the slopes of the upper and lower pole tip contours 26 are steeper than the slopes of the adjacent upper and lower pole contours 27 for initial acceleration. Beyond the comparatively slight slope of the upper and lower pole contours 27, the slopes of the upper and lower pole contours 28 for high-field acceleration again substantially increase (for the top contour 28) and decrease (for the bottom contour 28) to increase the rate at which the pole gap expands as a function of increasing radial distance from the central (main) axis 17.

Moving radially outward, the slopes of the surfaces of the upper and lower pole wings 29 are even steeper than (and inverse to) the slopes of the upper and lower pole contours 28, such that the size of the pole gap quickly drops (by a factor of more than five) with increasing radius between the pole wings 29. Accordingly, the structure of the pole wings 29 provides substantial shielding from the magnetic fields generated by the coils 12 toward the outer perimeter of the acceleration chamber by trapping inner field lines proximate to the coils 12 to thereby sharpen the drop off of the field beyond those trapped field lines. The furthest gap, which is between the junctions of the wing 29 with surface 28, is about 37 cm. This gap then abruptly narrows (at an angle between 80 and 90°—e.g., at an angle of about 85°—to the median acceleration plane 22) to about 6 cm between the tips 30. Accordingly, the gap between the pole wings 29 can be less than one-third (or even less than one-fifth) the size of the furthest gap between the poles. The gap between the coils 12, in this embodiment, is about 10 cm.

In embodiments where the magnetic field from the coils is increased, the coils 12 include more amp-turns and are split further apart from each other and are also positioned closer to the respective wings 29. Moreover, in the magnet structure designed for the increased field, the pole gap is increased between contours 27 and between contours 28), while the pole gap is narrowed between the perimeter tips 30 (e.g., to about 3.8 cm in a magnet structure designed for a 14 Tesla field) and between the center tip contours 26. Further still, in these embodiments, the thickness of the wings 29 (measured parallel to the acceleration plane 22) is increased. Moreover, the applied voltage is lower, and the orbits of the ions are more compact and greater in number; the axial and radial beam spread is smaller.

These contour changes, shown in FIG. 2, are representative only—as for each high-field-synchrocyclotron scaling solution, there may be a different number of pole taper changes to accommodate phase-stable acceleration and weak focusing; the surfaces may also have smoothly varying contours. Ions have an average trajectory in the form of a spiral expanding along a radius, r. The ions also undergo small orthogonal oscillations around this average trajectory. These small oscillations about the average radius are known as betatron oscillations, and they define particular characteristics of accelerating ions.

The upper and lower pole wings 29 sharpen the magnetic field edge for extraction by moving the characteristic orbit resonance, which sets the final obtainable energy closer to the pole edge. The upper and lower pole wings 29 additionally serve to shield the internal acceleration field from the strong split coil pair 12.

The pole profiles thus described contribute to several important acceleration functions, namely, ion guiding at low energy in the center of the machine, capture into stable acceleration paths, acceleration, axial and radial focusing, beam quality, beam loss minimization, and attainment of the final desired energy and intensity. In particular, in synchrocyclotrons, the simultaneous attainment of weak focusing and acceleration phase stability is achieved. At higher fields achieved in this magnet structure, the expansion of the pole gap over the first stage provides for sufficient weak focusing and phase stability, while the rapid closure of the gap over the outer stage is responsible for maintaining weak focusing against the deleterious effects of the strong superconducting coils, while properly positioning the full energy beam near the pole edge for extraction into the extraction channel. In embodiments, where the magnetic field to be generated by the magnet is increased, the rate at which the gap opening increases with increasing radius over the inner stage is made greater, while the gap is closed over the outer stage to a narrower separation distance.

Multiple radial passages 33 defined in the ferromagnetic iron yoke 11 provide access across the median acceleration plane 22 of the synchrocyclotron. The median-plane passages 33 are used for beam extraction and for penetration of the resonator inner conductor 58 and resonator outer conductor 59 (see FIG. 4). An alternative method for access to the ion-accelerating structure in the pole gap volume is through upper and lower axial RF passages 31.

The cold-mass structure and a surrounding cryostat (not shown) include a number of penetrations for leads, cryogens, structural supports and vacuum pumping, and these penetrations are accommodated within the ferromagnet core and yoke 11 through the upper-pole and lower-pole cryostat passages 32. The cryostat is constructed of a non-magnetic material (e.g., an INCONEL nickel-based alloy, available from Special Metals Corporation of Huntington, West Virginia, USA, or stainless steel or magnetic carbon steel).

Magnetic Extraction Bumps for Ion Extraction:

Ion extraction from a cyclotron can be very challenging due to rigidity (i.e., ion full energy is reached before the peak rigidity of the magnetic field across the median acceleration plane) and because orbital resonances may need to be avoided, as orbits may become unstable in the edge field. Rigidity is a measure of the "stiffness" of the magnetic field, being capable of holding in all ions with momentum, p<QrB at radius, r, and can be expressed as R=P/Q=rB Additionally, focusing may be needed due to the conversion of angular momentum to mechanical momentum, which can expand the ion beam in transverse directions. Moreover high extraction efficiency (i.e., ion beam out/ion beam in) may be a challenge, particularly due to limited turn separation (i.e., energy gain per turn is typically small) over successive orbital rotations about the central axis and because stop band resonance ($v_r=2v_z$) occurs well inside the pole edge, where the radial oscillation frequency, $v_r=\sqrt{1-n}$, and where the vertical oscillation frequency, $v_z=\sqrt{n}$. The radial oscillation frequency, $v_r$, can be expressed as $$v_r = \frac{\omega_r}{\omega_0}.$$

The momentum, p, of an accelerated ion as a function of radius can be expressed as p=QrB, where Q is the charge, r is radius from the central axis, and B is the magnetic field at the radius.

Figure 9:
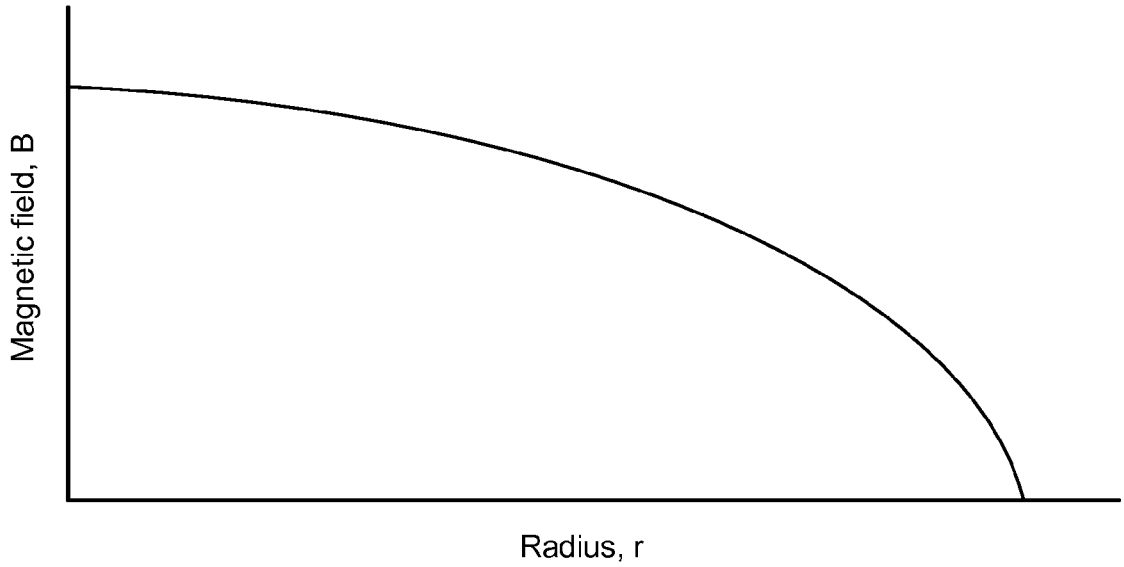
FIG. 9 is an approximate plot of magnetic field as a function of radius in a synchrocyclotron without the magnetic extraction bumps.
Figure 10:
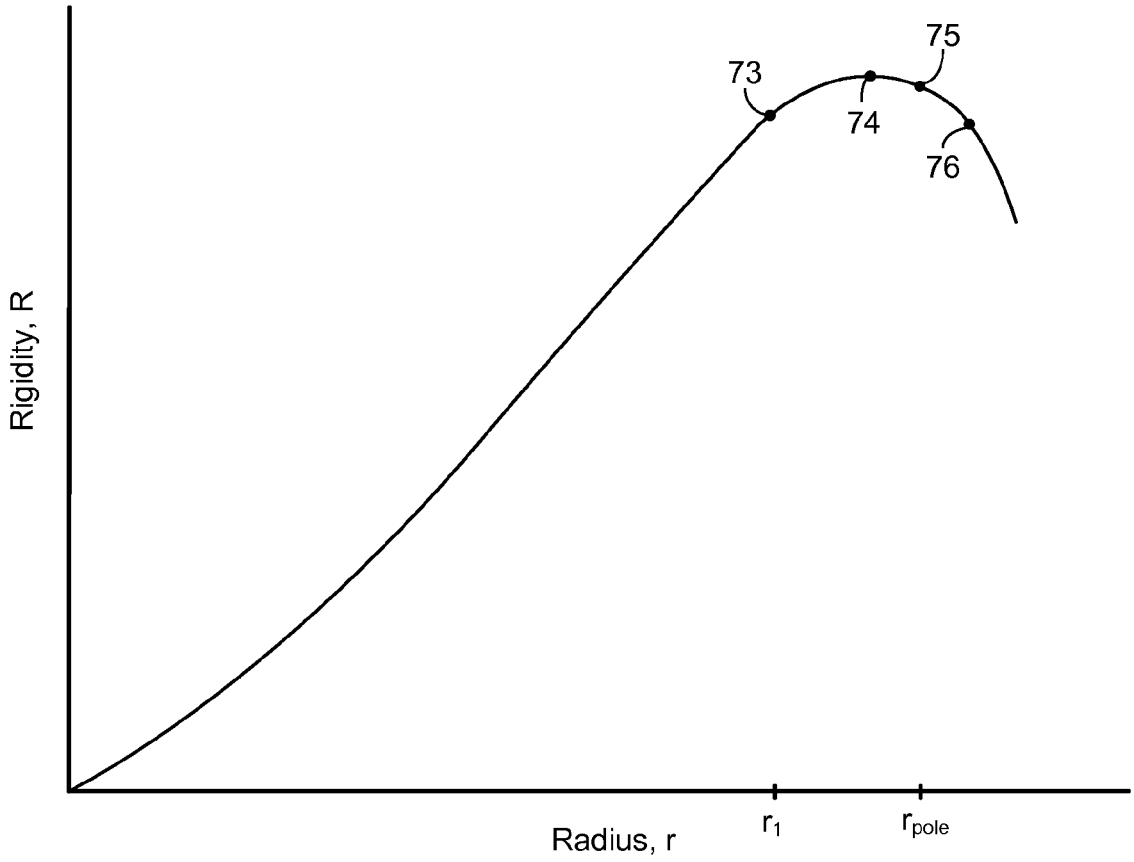
FIG. 10 is an approximate plot of rigidity as a function of radius.

An approximation of the magnetic field, B, as a function of radius, r, for a synchrocyclotron without the bumps, where n=0.2, is shown in FIG. 9, while an approximation of the rigidity, R, as a function of radius is shown in FIG. 10. As shown in FIG. 10, the accelerated ion reaches a maximum energy and momentum at point 73 (at radius, $r_1$), which can be at a radius that is greater than 93% of the full pole radius, $r_{pole}$ (at the near edge of the magnet cryostat cavity 15). The rigidity, R, reaches a maximum at 74. The far radius of the poles, $r_{pole}$, is marked as point 75. As the ion continues to spiral outward with maximum energy, it ceases to be confined by the magnetic field beyond point 76. Ultimately, the extraction system (e.g., the series of magnetic bumps 66) moves the ion over the range of radii from point 73 to point 76 for the ion to be extracted from the acceleration chamber. In this embodiment, $r_1/r_{pole}>0.9$.

Figure 7:
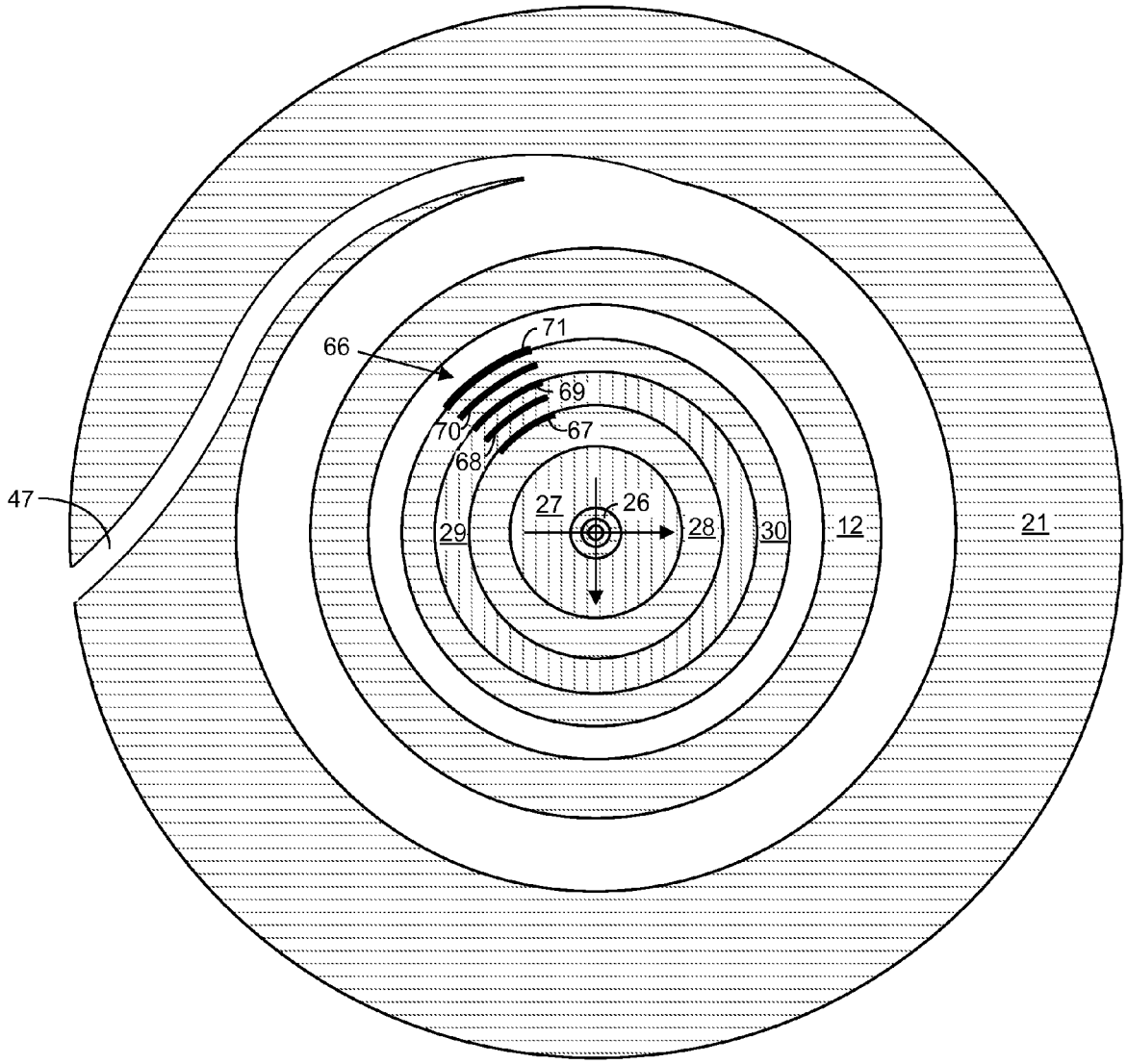
FIG. 7 is a top sectional view of the magnet structure showing the magnetic extraction bump configuration.
Figure 8:
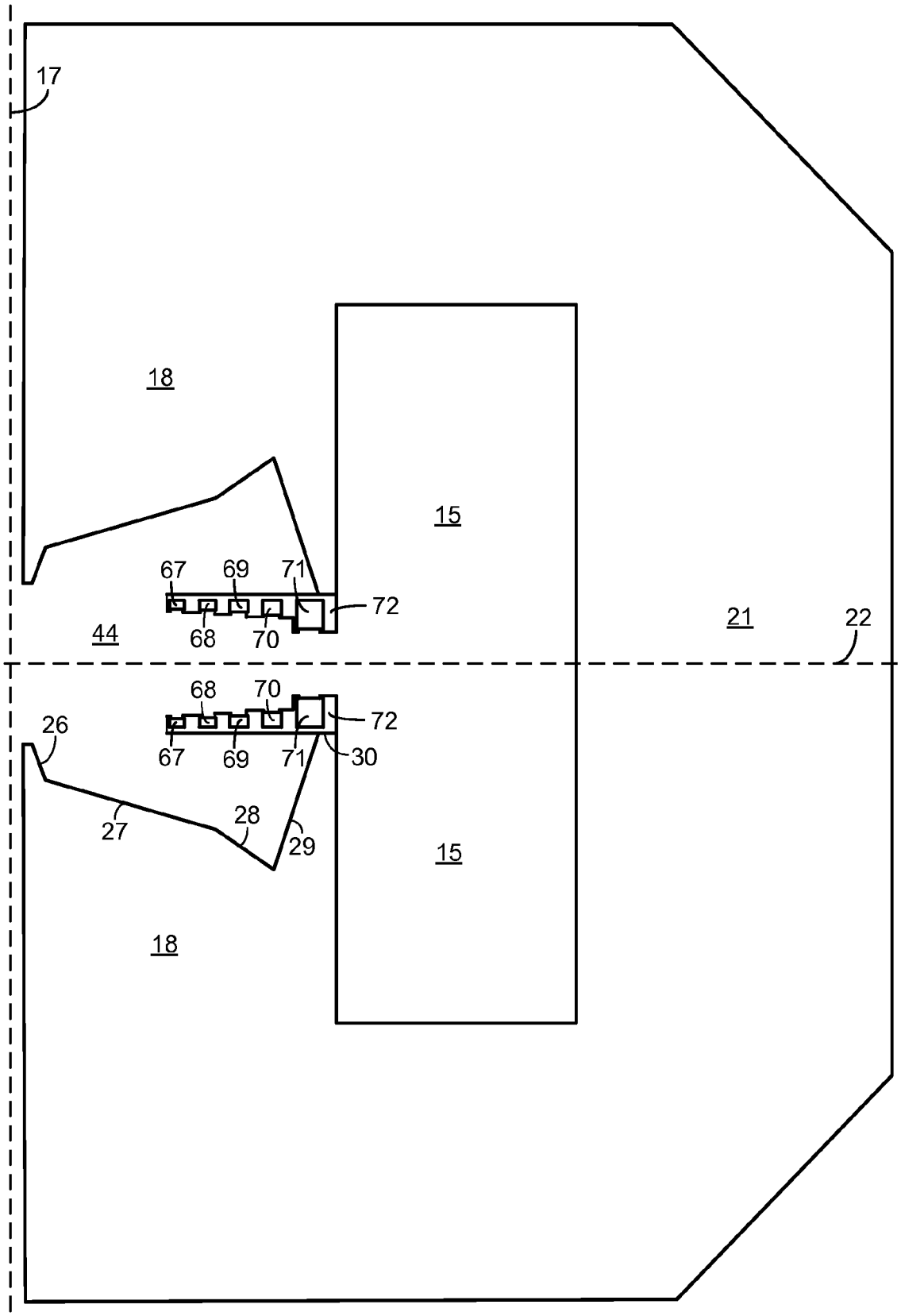
FIG. 8 is a side sectional view of the magnet structure showing the magnetic extraction bump configuration.

Extraction of the accelerated ion from the acceleration chamber is achieved via a series of discrete magnetic extraction bumps 66 (67, 68, 69, 70 and 71) extending at discrete radial increments from the central axis 17 and within an angular band (about the central axis 17) of 30° or less; the magnetic extraction bumps 66 can be mounted on or removed from the pole surfaces 30, as shown in FIGS. 7 and 8. A mirror-image replica (across the median acceleration plane 22) of the magnetic extraction bumps 66 is likewise provided on the opposite side of the median acceleration plane 22 at equal distances therefrom. The accelerated ion is released from its spiral orbit and exits through the extraction passage 47 soon after its orbit extends beyond the farthest bump 71. The magnetic extraction bumps 66 can be formed, e.g., of iron or a strong permanent magnet.

In the embodiment illustrated in FIG. 8, the magnetic extraction bumps 66 are mounted in or on a non-magnetic retainer structure 72 (formed, e.g., of a non-magnetic metal, such as aluminum, or a ceramic material), which, in turn, can be mounted to the wing tips 30 on the poles 18. In this embodiment, the radial distance to the inner edge (nearest the central axis 17), radial depth (measured horizontally in FIG. 8), and height (measured vertically in FIG. 8) of each bump 67-71 are as follows:

| Bump number | Inner radius | Radial depth of bump | Bump height |
|---|---|---|---|
| 67 | 19.5 cm | 1.0 cm | 0.2 cm |
| 68 | 22.5 cm | 0.9 cm | 0.35 cm |
| 69 | 25 cm | 1.2 cm | 0.4 cm |
| 70 | 28 cm | 0.9 cm | 0.8 cm |
| 71 | 30.425 cm | 1.5 cm | 2 cm |

The distance to the far edge of each bump 67-59 from the median acceleration plane 22 in this embodiment is 3.08 cm. In various embodiments, the energy of the accelerated ion can be altered by changing the radial locations of the bumps.

The magnetic extraction bumps 66 are confined within the cyclotron to a limited radial sector measured relative to the central axis 17 (e.g., extending across a radial angle no greater than 30°) to passively establish a non-axi-symmetric magnetic field at the radii of the magnetic extraction bumps 67, 68, 69, 70 and 71.

Each of the magnetic extraction bumps 67, 68, 69, 70 and 71 radially concentrates the magnetic field lines locally passing through the median acceleration plane 22, while also decreasing the magnetic field at radii just before and just beyond each bump. The magnetic extraction bumps 66 collectively provide a small "kick" (e.g., locally deviating the magnetic field in the median acceleration plane 22 by less than 5%) to bump the ions out of orbit. The bumps, however, can hold $v_r$ constant for about 30-40 orbital turns of the ion; and constant $v_r$ means that the equilibrium orbits are fixed and independent of energy. Consequently, a radial oscillation builds up, and the ions slip out of orbit.

Figure 11:
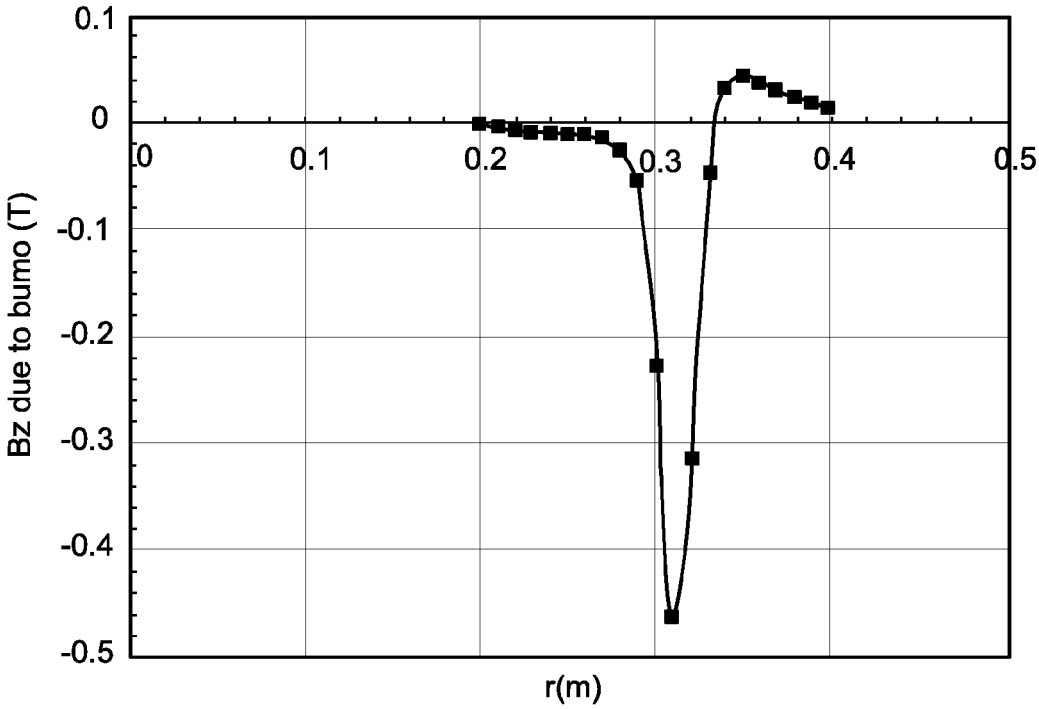
FIG. 11 is a plot of the magnetic extraction bump field ($B_z$) in the beam chamber as a function of orbital radius (r) at the central angle.

The magnetic field, $B_z$, component produced by a magnetic extraction bump as a function of radius at a central angle is plotted in FIG. 11, wherein the magnetic extraction bump is shown to provide a local perturbation with a magnitude of about 0.46 Tesla to the magnetic field in the median acceleration plane.

Figure 12:
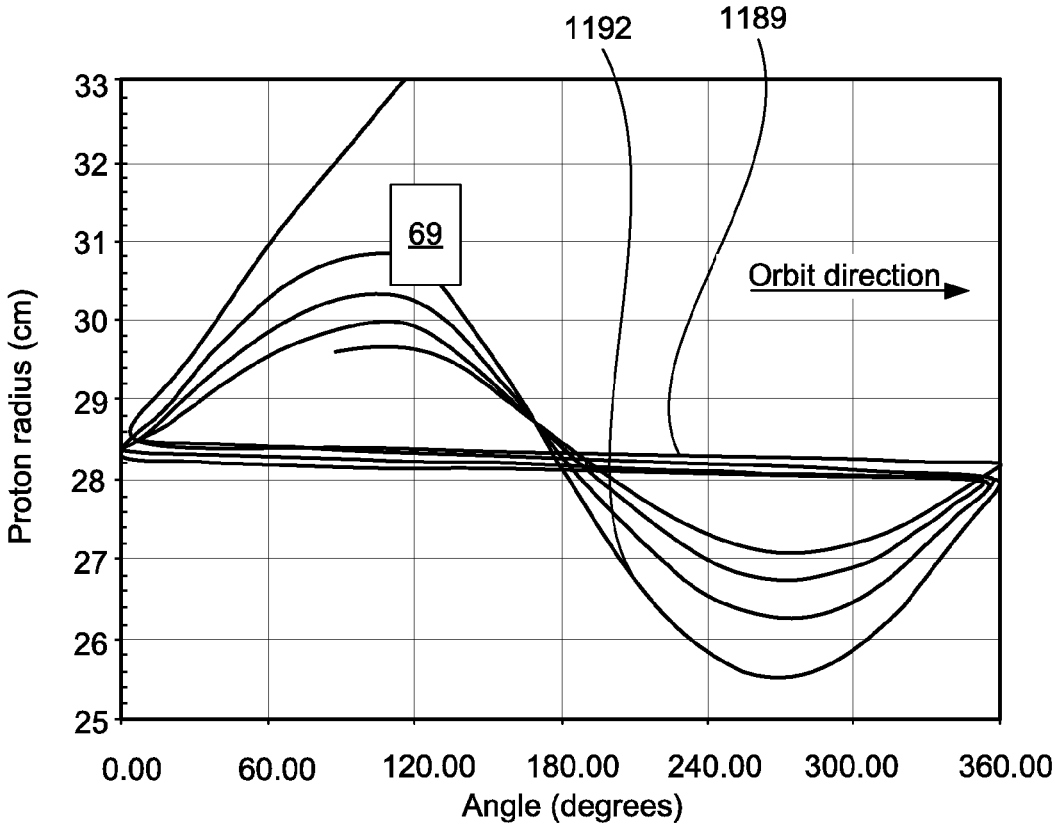
FIG. 12 is a plot of the radius of an orbiting proton as a function of the angle of rotation across the orbit over successive outward turns.

The radius of an accelerated proton over a series of turns (orbits) as a function of angle is plotted in FIG. 12. The proton orbit diverges from a near consistent radius until it reaches the magnetic extraction bumps, and turn numbers 1189-1192 (measured from an initial turn at a radius of 27.2 cm) are plotted in FIG. 12, which show that the radius of the orbit narrows at angular positions on the opposite side of the orbit from the final magnetic extraction bump 71 (centered at a radius near 31 cm, as shown), while the radius of the orbit widens at angular positions proximate the magnetic extraction bump 71, evidencing that the near-consistent-radius orbit is disrupted by the bumps 66 to enable extraction of the proton from the acceleration chamber 44.

Figure 13:
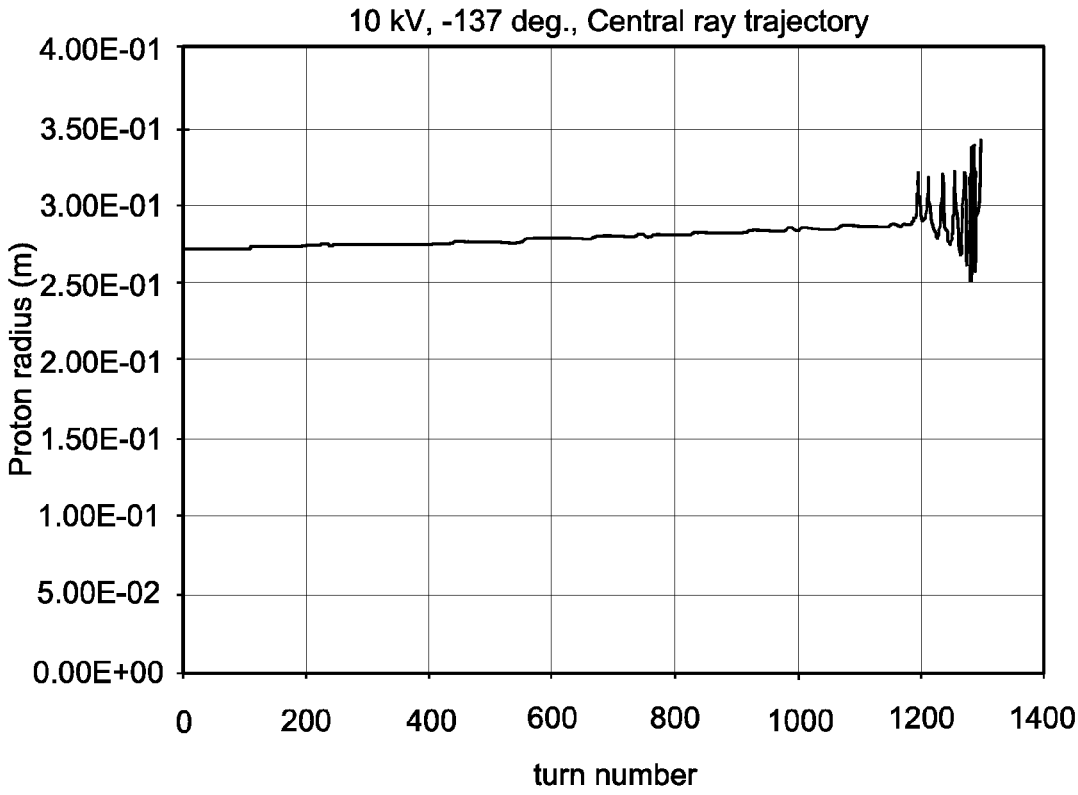
FIG. 13 is a plot of proton radius as a function of turn number.
Figure 14:
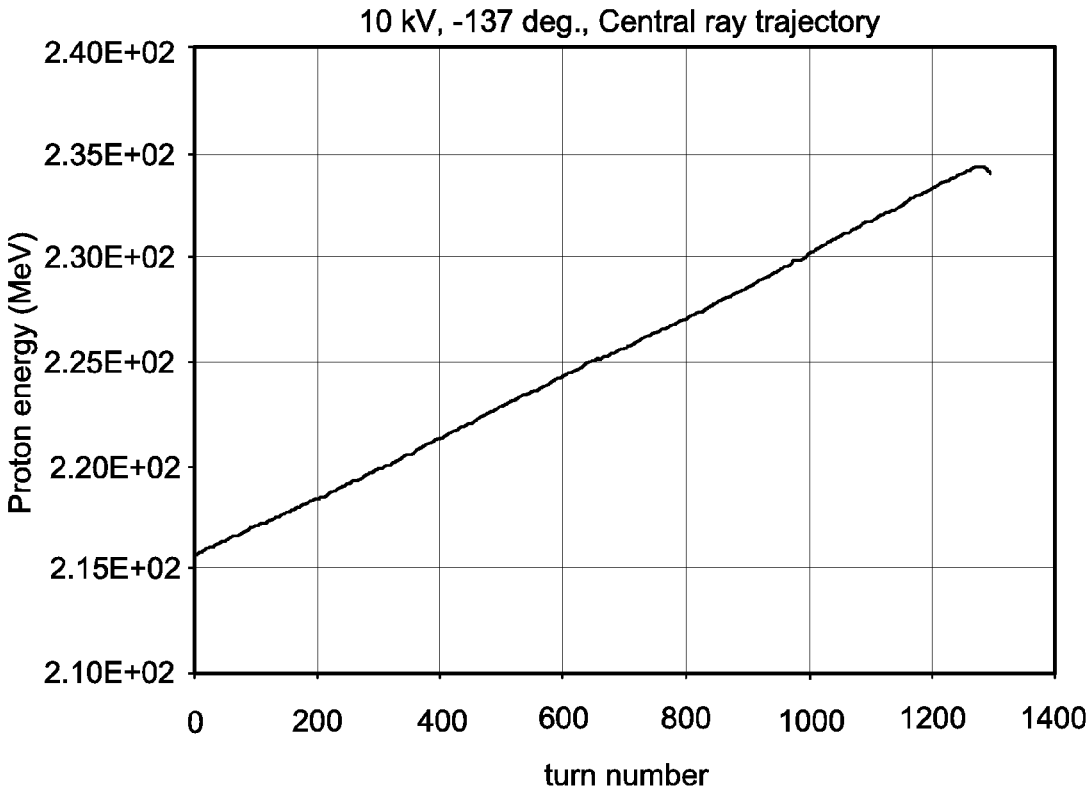
FIG. 14 is a plot of proton energy as a function of turn number.

The radius of the accelerated proton is plotted in FIG. 13 over a sequence of about 1300 turns from an initial radius of 27 cm, where significant radial variation in the orbit (discussed in the preceding paragraph) can be seen to commence just before turn 1200 and continue for the next [18] 100 turns as the ion is extracted. Meanwhile the energy of the accelerated proton is plotted in FIG. 14 over the same sequence of about 1300 turns. In this embodiment, the ions achieve an energy of about 234 MeV.

Figure 15:
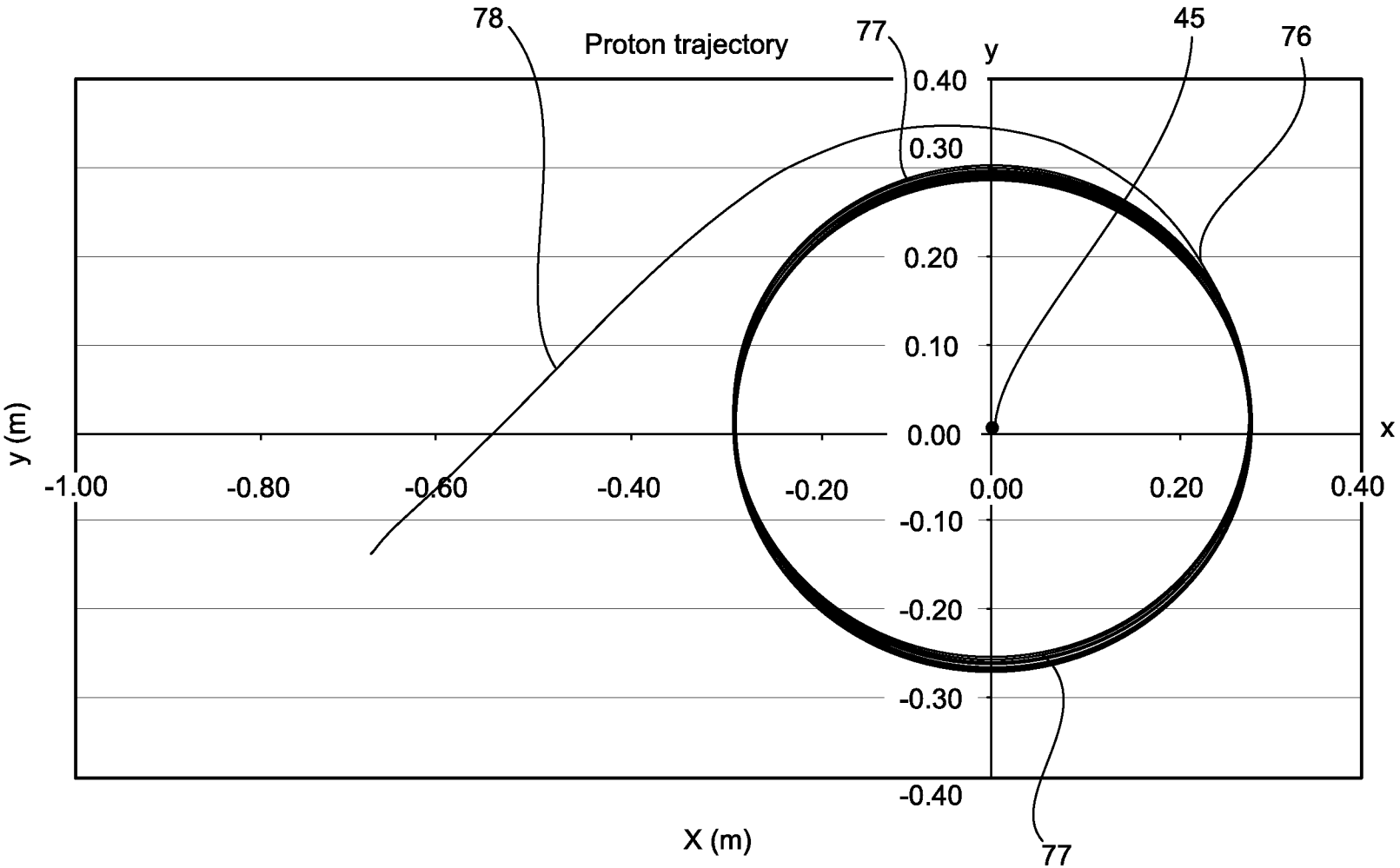
FIG. 15 provides an overhead view of the path of an accelerated ion over its final orbits and ejection from a synchrocyclotron.

An overhead view of the path of the ion over its final orbits is shown in FIG. 15. From an origin at an ion source 47, the ion spirals outwardly; and eventually, as the ion approaches the extraction bumps, orbit spacing broadens about opposite points 77 until the orbit ceases to be confined by the magnet structure at point 76, and the ion is then ejected from the synchrocyclotron via external trajectory 78.

Magnetic Circuit:

The ferromagnetic iron yoke 11 comprises a magnetic circuit that carries the magnetic flux generated by the superconducting coils 12 to the acceleration chamber 44. The magnetic circuit through the yoke 11 also provides field shaping for synchrocyclotron weak focusing at the upper and lower pole tips 19. The magnetic circuit also enhances the magnet field levels in the acceleration chamber by containing most of the magnetic flux in the outer part of the magnetic circuit, which includes the following ferromagnetic yoke elements: upper and lower pole roots 20 and upper and lower return yokes 21. The ferromagnetic yoke 11 is made of a ferromagnetic substance, which, even though saturated, provides the field shaping in the acceleration chamber 44 for ion acceleration.

As shown in FIG. 2, the upper and lower magnet cryostat cavities 15 contain the upper and lower superconducting coils 12 as well as the superconducting cold-mass structure and cryostat surrounding the coils, not shown. The location and shape of the coils 12 are also relevant to the scaling of a new synchrocyclotron orbit solution for a given E, Q, M and $V_0$, when $B_0$ is significantly increased. The bottom surface 25 of the upper coil 12' faces the opposite top surface 25 of the bottom coil 12". The upper-pole wing 29 faces the inner surface 24 of the upper coil 12'; and, similarly, the lower-pole wing 29 faces the inner surface 24 of the lower coil 12".

Equilibrium Orbit and Ion Acceleration:

Synchrocyclotrons are a member of the circular class of particle accelerators. The beam theory of the circular particle accelerators is well-developed, based upon the following two key concepts: equilibrium orbits and betatron oscillations around equilibrium orbits. The principle of equilibrium orbits (EOs) can be described as follows:

- a charge of given momentum captured by a magnetic field will transcribe an orbit;
- closed orbits represent the equilibrium condition for the given charge, momentum and energy;
- the field can be analyzed for its ability to carry a smooth set of equilibrium orbits; and
- acceleration can be viewed as a transition from one equilibrium orbit to another.

Meanwhile, the weak-focusing principle of perturbation theory can be described as follows:

- the particles oscillate about a mean trajectory (also, known as the central ray);
- oscillation frequencies ($v_r$, $v_z$) characterize motion in the radial (r) and axial (z) directions respectively;
- the magnet field is decomposed into coordinate field components and a field index (n); and $v_r=\sqrt{1-n}$, while $v_z=\sqrt{n}$; and
- resonances between particle oscillations and the magnetic field components, particularly field error terms, determine acceleration stability and losses.

In synchrocyclotrons, the weak-focusing field index parameter, n, noted above, is defined as follows:

$$n = -\frac{r}{B}\frac{dB}{dr},$$

where r is the radius of the ion (Q, M) from the central axis 17; and B is the magnitude of the axial magnetic field at that radius. The weak-focusing field index parameter, n, is in the range between zero and one across the entirety of the acceleration chamber (with the possible exception of the central region of the chamber proximate the central axis 17, where the ions are introduced and where the radius is near zero) to enable the successful acceleration of ions to full energy in the synchrocyclotron, where the field generated by the coils dominates the field index. In particular, a restoring force is provided during acceleration to keep the ions oscillating with stability about the mean trajectory. One can show that this axial restoring force exists when n>0, and this requires that dB/dr<0, since B>0 and r>0 are true. The synchrocyclotron has a field that decreases with radius to match the field index required for acceleration. Alternatively, if the field index is known, one can specify, to some level of precision, an electromagnetic circuit including the positions and location of many of the features, as indicated in FIG. 2, to the level at which further detailed orbit and field computations can provide an optimized solution. With such a solution in hand, one can then scale that solution to a parameter set ($B_0$, E, Q, M and $V_0$).

In this regard, the rotation frequency, w, of the ions rotating in the magnetic field of the synchrocyclotron can be expressed as follows:

$$\omega = QB/\gamma M,$$

where γ is the relativistic factor for the increase in the particle mass with increasing frequency. This decreasing frequency with increasing energy in a synchrocyclotron is the basis for the synchrocyclotron acceleration mode of circular particle accelerators, and gives rise to an additional decrease in field with radius in addition to the field index change that provides the axial restoring force. The voltage, $V_0$, across the gap is greater than a minimum voltage, $V_{min}$, needed to provide phase stability. When the radius, r, of the ion decreases, the accelerating electric field must increase, suggesting that there may by a practical limit to acceleration voltages with increasing magnetic field, B.

For a given known, working, high-field synchrocyclotron parameter set, the field index, n, that may be determined from these principle effects, among others, can be used to derive the radial variation in the magnetic field for acceleration. This B-versus-r profile can further be parameterized by dividing the magnetic fields in the data set by the actual magnetic-field value needed at full energy and also by dividing the corresponding radius values in this B-versus-r data set by the radius at which full energy is achieved. This normalized data set can then be used to scale to a synchrocyclotron acceleration solution at an even-higher central magnetic field, $B_0$, and resulting overall accelerator compactness, if it is also at least true that (a) the acceleration harmonic number, h, is constant, wherein the harmonic number refers to the multiplier between the acceleration-voltage frequency, $\omega_{RF}$, and the ion-rotation frequency, w, in the field, as follows:

$$\omega_{RF} = h\omega;$$

and (b) the energy gain per revolution, $E_t$, is constrained such that the ratio of $E_t$ to another factor is held constant, specifically as follows:

$$\frac{E_t}{QV_0 r^2 f(\gamma)} = \text{constant},$$

where $f(\gamma)=\gamma^2(1-0.25(\gamma^2-1))$.

Superconducting Coils and Bobbin Structure:

The superconducting coils can be formed, for example, of NbTi or $Nb_3Sn$. The superconducting material, NbTi, is used in superconducting magnets and can be operated at field levels of up to 7 Tesla at 1000 A/mm$^2$ and 4.5 K, while $Nb_3Sn$ can be operated at field levels up to approximately 12 Tesla at 3000 A/mm$^2$ and 4.5K. However, it is also possible to maintain a temperature of 2K in superconducting magnets by a process known as sub-cooling; and, in this case, the performance of NbTi can reach operating levels of about 9 Tesla at 2K and 2000A/mm$^2$, while $Nb_3Sn$ can reach about 15 Tesla at 2K and 4000 A/mm$^2$. In practice, one generally does not design magnets to operate at the field limit for superconducting stability. Additionally, the field levels at the superconducting coils may be higher than those in the pole gap, so actual operating magnetic-field levels may be lower. Furthermore, detailed differences among specific members of these two conductor families would broaden this range, as would operating at a lower current density. These approximate ranges for these known properties of the superconducting elements, in addition to the orbit scaling rules presented earlier, enable selection of a particular superconducting wire and coil technology for a desired operating field level in a compact, high-field superconducting synchrocyclotron. In particular, superconducting coils made of NbTi and $Nb_3Sn$ conductors and operating at 4.5K span a range of operating magnetic field levels from low fields in synchrocyclotrons to fields in excess of 10 Tesla. Decreasing the operating temperature further to 2K expands that range to operating magnetic field levels of at least 14 Tesla.

The upper and lower coils 12 are within a low-temperature-coil mechanical containment structure referred to as the bobbin 34. The bobbin 34 supports and contains the coils 12 in both radial and axial directions, as the upper and lower coils 12 have a large attractive load as well as a large radial outward force. The bobbin 34 provides axial support for the coils 12 through the coils' respective inward-facing surfaces 25. Providing access to the acceleration chamber 44, multiple radial passages are defined in and through the bobbin 34. In addition, multiple attachment structures (not shown) can be provided on the bobbin 34 so as to offer radial axial links for maintaining the position of the coil/bobbin assembly.

Figure 4:
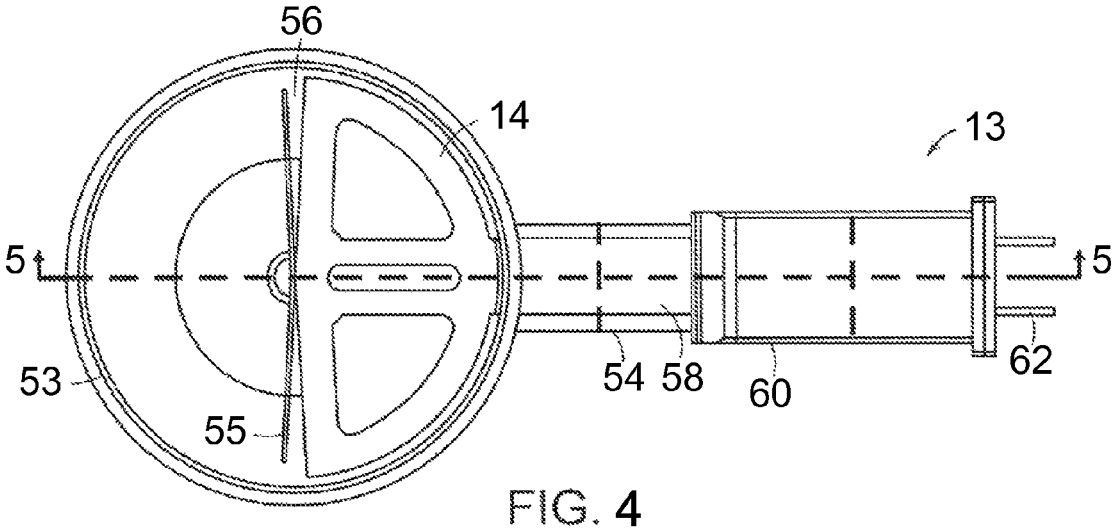
FIG. 4 is a sectional illustration of the synchrocyclotron beam chamber, accelerating dee and resonator.
Figure 5:
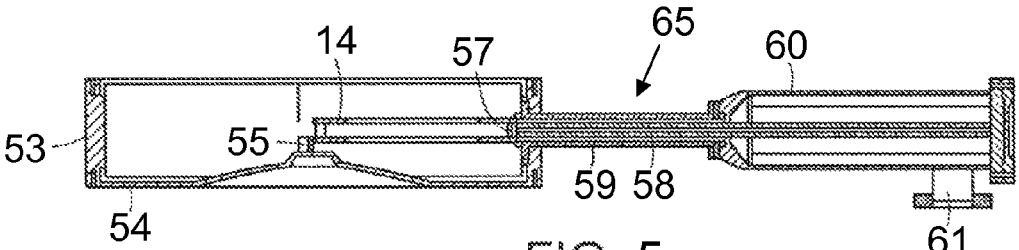
FIG. 5 is a sectional illustration of the apparatus of FIG. 4, with the section taken along the longitudinal axis shown in FIG. 4.

Resonator Structure:

The yoke 11 provides sufficient clearance for insertion of a resonator structure 13 including the radiofrequency (RF) accelerator electrodes 14 (also known as "dees") formed of a conductive metal, as shown in FIGS. 4 and 5. The electrodes 14 are part of a resonator structure 13 that extends through the sides of the yoke 11 and passes through the cryostat 35 and between the coils 12. The accelerator electrodes 14 include a pair of flat semi-circular parallel plates that are oriented parallel to and above and below the acceleration plane 22 inside the acceleration chamber 44 (as described and illustrated in U.S. Pat. No. 4,641,057). The electrodes 14 are coupled with an RF voltage source (not shown) that generates an oscillating electric field to accelerate emitted ions from the ion source 45 in an expanding orbital (spiral) path in the acceleration chamber 44. Additionally, a dummy dee 55 can be provided in the form of a planar sheet oriented in a plane of the central axis 17 (i.e., a plane that intersects the central axis 17 in the orientation of FIGS. 3 and 5 and extends orthogonally from the page) and having a slot defined therein to accommodate the acceleration plane for the particles. Alternatively, the dummy dee 55 can have a configuration identical to that of the electrodes 14, though the dummy dee 55 would be coupled with an electrical ground rather than with a voltage source.

The resonator structure 13 provides for phase-stable ion acceleration. FIGS. 4 and 5 provide a detailed engineering layout of one type of beam-accelerating structure, with a beam chamber 53 and a resonator 13, for the 9.2-Tesla solution of FIG. 1, where the chamber 53 is located in the pole gap space. The elevation view of FIG. 4 shows only one of the dees 14 used for accelerating the ions, while the side view shows of FIG. 5 that this dee 14 is split above and below the median plane for the beam to pass therethrough during acceleration. The dee 14 and the ions are in a volume under vacuum and defined by the beam chamber 53, which includes a beam-chamber base plate 54 and a top plate (not shown) with the same shape and configuration as the base plate 54, with the dummy dee 55 extending from both plates. The acceleration-gap-defining dummy dee aperture 55 establishes the electrical ground plane; and the ions are accelerated by the electric field across the acceleration gap 56 between the dee 14 and the dummy dee aperture 55.

To establish the high fields desired across the gap 56, the dees 14 are connected to a resonator inner conductor 58 through dee-resonator connector 57. The outer resonator conductor 59 is connected to a cryostat surrounding the cold-mass structure and providing a vacuum boundary. The resonator frequency is varied by an RF rotating capacitor (not shown), which is connected to the accelerating dee 14 and the inner and outer conductors 58 and 59 through the resonator outer conductor return yoke 60 through the coupling port 61. Power is delivered to the RF resonant circuit through RF-transmission-line coupling port 62.

In another embodiment, an alternative structure with two dees and axial RF resonator elements is incorporated into the compact high-field superconducting synchrocyclotron. Such a two-dee system may allow for increased acceleration rates or reduced voltages, $V_0$.

Figure 6:
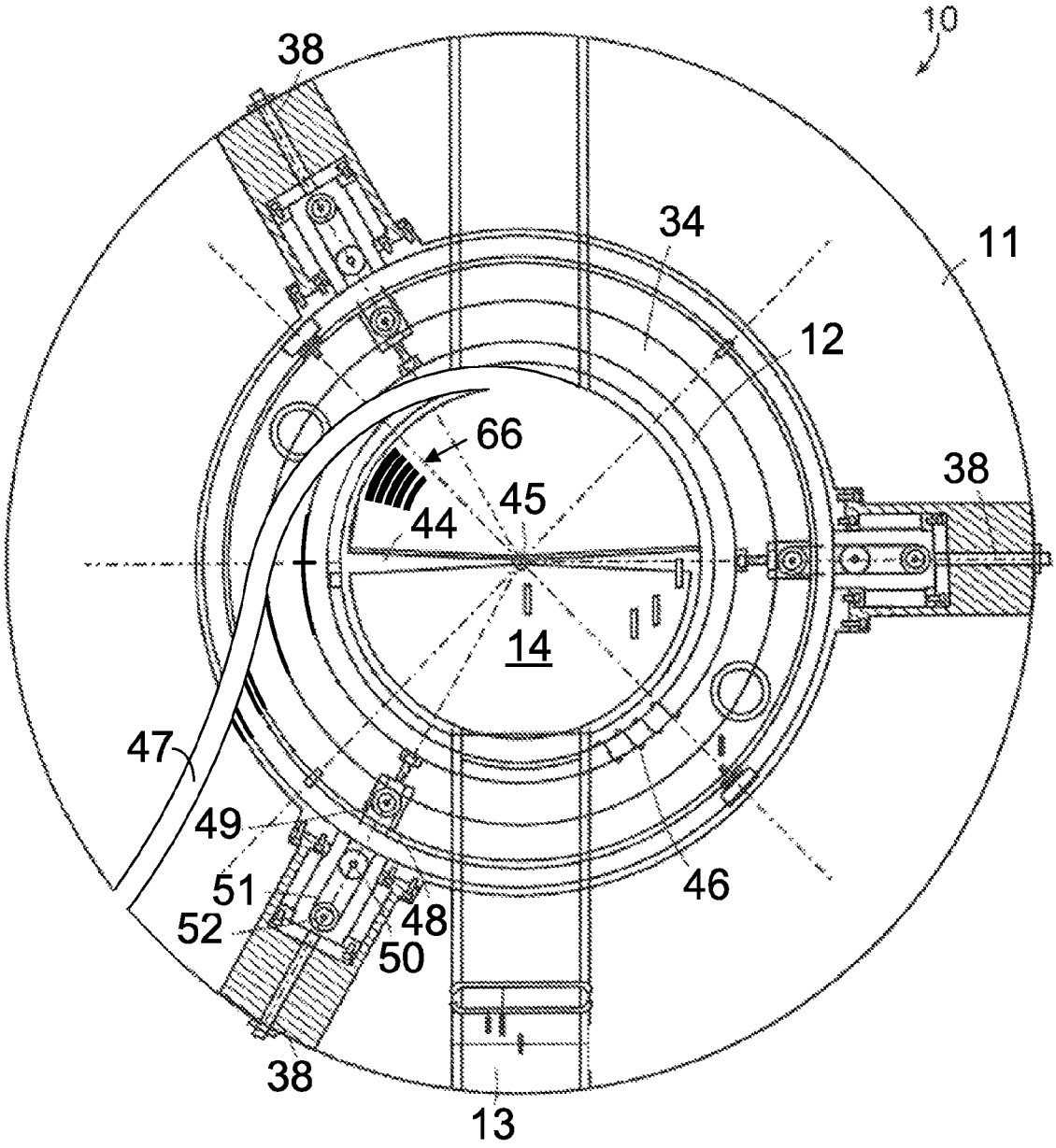
FIG. 6 is a sectional illustration of the magnet structure of FIG. 3, viewed in a plane normal to the central axis and parallel to the acceleration plane.

Cooling and Vacuum:

A more complete and detailed illustration of a magnet structure 10 for particle acceleration is illustrated in FIGS. 3 and 6. As shown in FIG. 3, cryocoolers 64 with cryocooler heads 39 and 40, which can utilize compressed helium in a Gifford-McMahon refrigeration cycle or which can be of a pulse-tube cryocooler design, are thermally coupled with a cold-mass structure comprising the coils 12 and the bobbin 34. The coupling can be in the form of a low-temperature superconductor (e.g., NbTi) current lead in contact with the coil 12 or high-purity copper. The cryocoolers 64 can cool each coil 12 to a temperature at which it is superconducting. Accordingly, each coil 12 can be maintained in a dry condition (i.e., not immersed in liquid helium or other liquid refrigerant) during operation, and no liquid coolant need be provided in or about the cold-mass structure either for cool-down of the cold mass or for operating of the superconducting coils 12; though liquid coolant can be provided to facilitate cooling of the coils in other embodiments.

A second pair of cryocoolers 64, which can be of the same or similar design to the first of cryocoolers 64, are coupled with the current leads 41 and 42 and to the coils 12. The high-temperature current leads 41 can be formed of a high-temperature superconductor, such as $Ba_2Sr_2Ca_1Cu_2O_8$ or $Ba_2Sr_2Ca_2Cu_3O_{10}$, and are cooled at one end by the cold heads 39 at the end of the first stages of the cryocoolers 64, which are at a temperature of about 80 K, and at their other end by the cold heads 40 at the end of the second stages of the cryocoolers 64, which are at a temperature of about 4.5 K. The high-temperature current leads 41 are also conductively coupled with a voltage source.

Lower-temperature current leads 42 are coupled with the higher-temperature current leads 41 to provide a path for electrical current flow and also with the cold heads 40 at the end of the second stages of the cryocoolers 64 to cool the low-temperature current leads 42 to a temperature of about 4.5 K. Each of the low-temperature current leads 42 also includes an electrically conductive wire that is attached to a respective coil 12; and another electrically conductive wire, also formed of a low-temperature superconductor, couples in series the two coils 12. Each of the wires can be affixed to the bobbin 34. Accordingly, electrical current can flow from an external circuit possessing a voltage source, through a first of the high-temperature current leads 41 to a first of the low-temperature current leads 42 and into coil 12; the electrical current can then flow through a coil 12 and then exit through the wire joining the coils 12. The electrical current then flows through the other coil 12 and exits through the wire of the second low-temperature current lead 42, up through the low-temperature current lead 42, then through the second high-temperature current lead 41 and back to the voltage source.

The cryocoolers 64 allow for operation of the magnet structure away from sources of cryogenic cooling fluid, such as in isolated treatment rooms or also on moving platforms. The pair of cryocoolers 64 permit operation of the magnet structure with only one cryocooler 64 of each pair having proper function.

At least one vacuum pump (not shown) is coupled with the acceleration chamber 44 via the channel for the resonator 65 in which a current lead for the RF accelerator electrode 14 is also inserted. The acceleration chamber 44 is otherwise sealed, to enable the creation of a vacuum in the acceleration chamber 44.

Tension Links:

Radial-tension links 38 are coupled with the coils 12 and bobbin 34 in a configuration whereby the radial-tension links 38 can provide an outward hoop force on the bobbin 34 at a plurality of points so as to place the bobbin 34 under radial outward tension and keep the coils 12 centered (i.e., substantially symmetrical) about the central axis 17. As such, the tension links 38 provide radial support against magnetic de-centering forces whereby the cold mass approaching the iron on one side sees an exponentially increasing force and moves even closer to the iron. The radial-tension links 38 comprise two or more elastic tension bands 48 and 51 with rounded ends joined by linear segments (e.g., in the approximate shape of a conventional race or running track) and have a right circular cross-section. The bands can be formed, e.g., of spiral wound glass or carbon tape impregnated with epoxy and are designed to minimize heat transfer from the high-temperature outer frame to the low-temperature coils 12. A low-temperature band 48 extends between support peg 49 and support peg 50. The lowest-temperature support peg 49, which is coupled with the bobbin 34, is at a temperature of about 4.5 K, while the intermediate peg 50 is at a temperature of about 80 K. A higher-temperature band 51 extends between the intermediate peg 50 and a high-temperature peg 52, which is at a near-ambient temperature of about 300 K. An outward force can be applied to the high-temperature peg 52 to apply additional tension at any of the tension links 38 to maintain centering as various de-centering forces act on the coils 12. The pegs 49, 50, and 52 can be formed of stainless steel.

Likewise, similar tension links can be attached to the coils 12 along a vertical axis (per the orientation of FIG. 3) to counter an axial magnetic decentering force in order to maintain the position of the coils 12 symmetrically about the mid-plane 22. During operation, the coils 12 will be strongly attracted to each other, though the thick bobbin 34 section between the coils 12 will counterbalance those attractive forces.

The set of radial and axial tension links support the mass of the coils 12 and bobbin 34 against gravity in addition to providing the centering force. The tension links may be sized to allow for smooth or step-wise three-dimensional translational or rotational motion of the entire magnet structure at a prescribed rate, such as for mounting the magnet structure on a gantry, platform or car to enable moving the proton beam in a room around a fixed targeted irradiation location. Both the gravitational support and motion requirements are tension loads not in excess of the magnetic de-centering forces. The tension links may be sized for repetitive motion over many motion cycles and years of motion.

Operation of the Magnetic Structure to Accelerate Ions:

When the magnet structure 10 is in operation, the cryocoolers 64 are used to extract heat from the superconducting coils 12 so as to drop the temperature of each below its critical temperature (at which it will exhibit superconductivity). The temperature of coils 12 formed of low-temperature superconductors is dropped to about 4.5 K.

A voltage (e.g., sufficient to generate 2,000 A of current through the current lead in the embodiment with 1,500 windings in the coil, described above) is applied to each coil 12 via the current lead 42 to generate a magnetic field of at least 8 Tesla within the acceleration chamber 44 when the coils are at 4.5 K. In particular embodiments using coils formed of, e.g., $Nb_3Sn$, a voltage is applied to the coils 12 to generate a magnetic field of at least about 9 Tesla within the acceleration chamber 44. Moreover, the field can generally be increased by an additional 2 Tesla by using the cryocoolers 64 to further drop the coil temperature to 2 K, as discussed above. The magnetic field includes a contribution of about 2 Tesla from the fully magnetized iron poles 18; the remainder of the magnetic field is produced by the coils 12.

This magnet structure serves to generate a magnetic field sufficient for ion acceleration. Pulses of ions (e.g., protons) can be emitted from the ion source 45 (e.g., the ion source described and illustrated in U.S. Pat. No. 4,641,057). Free protons can be generated, e.g., by applying a voltage pulse to an ion source 45 in the form of a cathode to cause electrons to be discharged from the cathode into hydrogen gas, wherein protons are emitted when the electrons collide with the hydrogen molecules.

In this embodiment, The RF accelerator electrodes 14 generate a voltage difference of 20,000 Volts across the plates. The electric field generated by the RF accelerator electrodes 14 has a frequency matching that of the cyclotron orbital frequency of the ion to be accelerated. The field generated by the RF accelerator electrodes 14 oscillates at a frequency of 140 MHz when the ions are nearest the central axis 17, and the frequency is decreased to as low as 100 MHz when the ions are furthest from the central axis 17 and nearest the perimeter of the acceleration chamber 44. The frequency is dropped to offset the increase in mass of the proton as it is accelerated, as the alternating frequency at the electrodes 14 alternately attracts and repels the ions. As the ions are thereby accelerated in their orbit, the ions accelerate and spiral outward. The frequency drop also accounts for the falling field with radius, as shown in FIG. 9.

When the accelerated ions reach an outer radial orbit in the acceleration chamber 44, the ions can be drawn out of the acceleration chamber 44 (e.g., in the form of a pulsed beam) by magnetically leading them out of their spiral orbits with the series of magnetic extraction bumps 66 into a linear beam-extraction passage 47 extending from the acceleration chamber 44 through the yoke 11 and then through a gap in the integral magnetic shield 23 toward, e.g., an external target. The radial tension links 38 are activated to impose an outward radial hoop force on the cold-mass structure to maintain its position throughout the acceleration process.

The integral magnetic shield 23 contains the magnetic field generated by the coils 12 and poles 18 so as to reduce external hazards accompanying the attraction of, e.g., pens, paper clips and other metallic objects toward the magnet structure 10, which would occur absent employment of the integral magnetic shield 23. Interaction between the magnetic field lines and the integral magnetic shield 23 at various angles is highly advantageous, as both normal and tangential magnetic fields are generated by the magnet structure 10, and the optimum shield orientation for containing each differs by 90°. This shield 23 can limit the magnitude of the magnetic field transmitted out of the yoke 11 through the shield 23 to less than 5 Gauss (0.00005 Tesla).

When an increase in voltage or a drop in current through a coil 12 is detected, thereby signifying that a localized portion of the superconducting coil 12 is no longer superconducting, a sufficient voltage is applied to the quenching wire 46 that encircles the coil 12. This voltage generates a current through the wire 46, which thereby generates an additional magnetic field to the individual conductors in the coil 12, which renders them non-superconducting (i.e., "normal") throughout. This approach solves a perceived problem in that the internal magnetic field in each superconducting coil 12, during operation, will be very high (e.g., 11 Tesla) at its inner surface 24 and will drop to as low as zero at an internal point. If a quench occurs, it will likely occur at a high-field location while a low-field location may remain cold and superconducting for an extended period. This quench generates heat in the parts of the superconductor of coils 12 that are normal conducting; consequently, the edge will cease to be superconducting as its temperature rises, while a central region in the coil will remain cold and superconducting. The resulting heat differential would otherwise cause destructive stresses in the coil due to differential thermal contraction. This practice of inductive quenching is intended to prevent or limit this differential and thereby enable the coils 12 to be used to generate even higher magnetic fields without being destroyed by the internal stresses. Alternatively, current may be passed through heater strips adjacent to the coils, causing the heater strip temperatures to rise well above 4.5 K and thereby locally heat the superconductors to minimize the internal temperature differentials during a quench.

Exemplary Applications:

Cyclotrons incorporating the above-described apparatus can be utilized for a wide variety of applications including proton radiation therapy for humans; etching (e.g., microholes, filters and integrated circuits); radioactivation of materials for materials studies; tribology; basic-science research; security (e.g., monitoring of proton scattering while irradiating target cargo with accelerated protons); production of medical isotopes and tracers for medicine and industry; nanotechnology; advanced biology; and in a wide variety of other applications in which generation of a point-like (i.e., small spatial-distribution) beam of high-energy particles from a compact source would be useful.

Equivalents

In describing embodiments of the invention, specific terminology is used for the sake of clarity. For the purpose of description, specific terms are intended to at least include technical and functional equivalents that operate in a similar manner to accomplish a similar result. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Further, where parameters for various properties or other values are specified herein for embodiments of the invention, those parameters or values can be adjusted up or down by 1/100th, 1/50th, 1/20th, 1/10th, 1/5th, 1/3rd, 1/2, 2/3rd, 3/4th, 4/5th, 9/10th, 19/20th, 49/50th, 99/100th, etc. (or up by a factor of 1, 2, 3, 4, 5, 6, 8, 10, 20, 50, 100, etc.), or by rounded-off approximations thereof, unless otherwise specified. Moreover, while this invention has been shown and described with references to particular embodiments thereof, those skilled in the art will understand that various substitutions and alterations in form and details may be made therein without departing from the scope of the invention. Further still, other aspects, functions and advantages are also within the scope of the invention; and all embodiments of the invention need not necessarily achieve all of the advantages or possess all of the characteristics described above. Additionally, steps, elements and features discussed herein in connection with one embodiment can likewise be used in conjunction with other embodiments. The contents of references, including reference texts, journal articles, patents, patent applications, etc., cited throughout the text are hereby incorporated by reference in their entirety; and appropriate components, steps, and characterizations from these references may or may not be included in embodiments of this invention. Still further, the components and steps identified in the Background section are integral to this disclosure and can be used in conjunction with or substituted for components and steps described elsewhere in the disclosure within the scope of the invention. For example, while the magnetic extraction bumps are particularly described, herein, in the context of particular synchrocyclotron designs, the magnetic extraction bumps can be likewise incorporated into a variety of other cyclotron classes (e.g., classical cyclotrons and isochronous cyclotrons) and designs. In method claims, where stages are recited in a particular order—with or without sequenced prefacing characters added for ease of reference—the stages are not to be interpreted as being temporally limited to the order in which they are recited unless otherwise specified or implied by the terms and phrasing.

What is claimed is:

1. A cyclotron comprising:

a pair of magnetic coils encircling a central axis and positioned on opposite sides of a median acceleration plane;

a magnetic yoke encircling the central axis and including a return yoke that crosses the median acceleration plane and a first and second pole on opposite sides of the median acceleration plane; and a series of magnetic extraction bumps extending in series from the central axis on opposite sides of the median acceleration plane, wherein the extraction bumps are positioned non-axially symmetrically across distinct radial distances from the central axis and separated from each other by radial gaps such that the extraction bumps are configured to displace an ion that is accelerating through the median acceleration plane in an outwardly expanding orbit about the central axis out of its orbit and out of the cyclotron.

2. The cyclotron of claim 1, further comprising an ion source proximal the central axis and the median acceleration plane.

3. The cyclotron of claim 1, wherein the magnetic extraction bumps comprise iron.

4. The cyclotron of claim 1, wherein the magnetic yoke comprises iron.

5. The cyclotron of claim 1, wherein the magnetic coils comprise niobium tin or niobium titanium.

6. The cyclotron of claim 1, wherein the magnetic extraction bumps are confined to an angle no greater than 30° about the central axis.

7. The cyclotron of claim 6, wherein at least five magnetic extraction bumps are provided, each separate from the other magnetic extraction bumps and extending across a distinct radial distance from the central axis .

8. The cyclotron of claim 7, wherein the magnetic extraction bumps are radially separated from each other by at least 1 cm.

9. The cyclotron of claim 6, wherein the magnetic extraction bumps extend across radii of about one-third the pole radius from the central axis to about the pole radius.

10. The cyclotron of claim 6, wherein the height of the magnetic extraction bumps increase with increasing radius from the central axis such that magnetic extraction bumps at shorter radii have lower heights than magnetic extraction bumps at greater radii.

11. The cyclotron of claim 6, wherein the magnetic extraction bumps have heights in a range from 0.1 to 4 cm.

12. The cyclotron of claim 6, wherein the magnetic extraction bumps have radial depths in a range from 0.5 to 3 cm.

13. The cyclotron of claim 1, wherein the extraction bumps are positioned along a common radius passing through the central axis.

14. The cyclotron of claim 13, wherein the extraction bumps are radially separated from each other by at least 1 cm.

15. The cyclotron of claim 14, wherein the magnetic extraction bumps have heights, measured orthogonally to the median acceleration plane, that increase with increasing radius from the central axis such that extraction bumps positioned at further radii have greater heights than extraction bumps positioned at shorter radii.

16. The cyclotron of claim 15, wherein the extraction bumps have heights, measure orthogonally to the median acceleration plane, in a range from 0.1 to 4 cm.

17. A method for ion extraction from a cyclotron, the method comprising:

releasing an ion into an acceleration chamber contained in the cyclotron;

accelerating the ion in an outward spiral orbit in the acceleration chamber; and extracting the accelerated ion from the acceleration chamber via a magnetic-field perturbation produced by a series of magnetic extraction bumps separated across distinct radial distances from the central axis and positioned orthogonal to the orbit of the accelerating ion such that the magnetic-field perturbation produced by the magnetic extraction bumps destabilizes the orbit of the accelerating ion.

18. The method of claim 17, wherein the cyclotron includes a pair of magnetic poles on opposite sides of the acceleration chamber and encircling and extending from a central axis, and wherein the ion reaches full energy in the acceleration chamber at a radius greater than 93% of the pole radius.

19. The method of claim 17, wherein the cyclotron generates a magnetic field greater than 6 Tesla in the acceleration chamber.

20. The method of claim 17, wherein the magnetic extraction bumps passively influence the magnetic field in a local sector of the acceleration chamber.

* * * * *